US009198462B2

(12) United States Patent
Ghanavi

(10) Patent No.: US 9,198,462 B2
(45) Date of Patent: Dec. 1, 2015

(54) NANOSTRUCTURAL FILTER FOR REMOVING TOXIC COMPOUNDS

(76) Inventor: Jalaledin Ghanavi, Tehran (IR)

( * ) Notice: Subject to any disclaimer, the term of this patent is extended or adjusted under 35 U.S.C. 154(b) by 939 days.

(21) Appl. No.: 13/413,671

(22) Filed: Mar. 7, 2012

(65) Prior Publication Data

US 2012/0160255 A1 Jun. 28, 2012

Related U.S. Application Data

(60) Provisional application No. 61/530,991, filed on Sep. 4, 2011.

(51) Int. Cl.

| | |
|---|---|
| ***A24D 3/06*** | (2006.01) |
| ***A24D 3/16*** | (2006.01) |
| ***A24D 3/08*** | (2006.01) |
| ***A24D 3/14*** | (2006.01) |

(52) U.S. Cl.
CPC *A24D 3/16* (2013.01); *A24D 3/063* (2013.01); *A24D 3/08* (2013.01); *A24D 3/14* (2013.01)

(58) Field of Classification Search
None
See application file for complete search history.

(56) References Cited

U.S. PATENT DOCUMENTS

2005/0053784 A1 * 3/2005 Wood et al. ..... A61L 15/28 428/372

FOREIGN PATENT DOCUMENTS

JP 2003313455 A * 11/2003

OTHER PUBLICATIONS

JP 2003313455 A—Derwent record in English.*

* cited by examiner

*Primary Examiner* — Michael J Felton
(74) *Attorney, Agent, or Firm* — Barry Choobin

(57) ABSTRACT

The various embodiments herein provide an electrospun fiber mat filter comprising a cigarette filter containing macrocycle for removing toxic compounds from a toxic material, wherein the toxic material comprises liquid, gas, and cigarette smoke and a method of synthesizing the same. The electrospun fiber mat cigarette filter comprises a biological, organic or synthetic macrocycle, plurality of additives, a solvent and an acceptable polymeric carrier. The biological macromolecules are engineered polyhemoglobin and/or chlorophyll. The biological, organic, or synthetic macrocycle are electrospun with the acceptable polymeric carrier in presence of an abruptly asymmetric electric field to form an electrospun fiber mat. The electrospun fiber mat is made up of networks of plurality of nanofibers.

17 Claims, 19 Drawing Sheets

NANOSTRUCTURAL FILTER FOR REMOVING TOXIC COMPOUNDS

CROSS REFERENCE TO RELATED APPLICATIONS

This application claims the benefit of U.S. Provisional Application Ser. No. 61/530,991, filed Sep. 4, 2011.

BACKGROUND

1. Technical Field

The embodiments herein generally relate to the electrospun fiber mat filter containing macrocycle for removing toxic compounds from a toxic material, wherein the toxic material comprises liquid, gas, and cigarette smoke. The electrospun cigarette filters for removing toxic compounds from a cigarette smoke and more particularly to an electro spun cigarette filter that can be used alone or can be woven with conventional cigarette filters for removing toxic compounds from the cigarette smoke. The embodiments herein also relate to a method of synthesizing the electrospun cigarette filter that removes toxic compounds from the cigarette smoke.

2. Description of the Related Art

The cigarette smoke contains a multitude of harmful components. An important component in tobacco smoke or cigarette smoke that is harmful to the health of smokers is tar. The tar consists of many carcinogenic compounds. In commercially available cigarettes, the tar content of the smoke is mainly reduced by the use of filters placed inside a cigarette. Conventionally, the filters are made up of organic materials such as cellulose or modified cellulose like acetate cellulose. Further the hazardous compounds contain numerous metals and oxidants that are found toxic. The combination of both metals and oxidants is devastating for human health. Other harmful components of tobacco smoke are carbon monoxide, hydrocyanic acid, acetic aldehyde and formic aldehyde, nitrosamines, sulphur dioxide, phenols, mercury, nickel, iron, copper, chromium, aluminium, vanadium, lead, cobalt, silicon, titanium, manganese, zinc, cadmium, barium, strontium and arsenic compounds which are only adsorbed or absorbed to a minor extent by the conventional filters. Therefore several specific filters have been developed to reduce the concentration of these compounds in cigarette smoke.

The metal pollutants in cigarette smoke as well as the oxidants such as hydrogen peroxide, peroxyradicals, nitrogen oxides, and combination thereof exert devastating effects on human cells leading to contraction of cells, functional impairment and cell death. An oxidative damage based on cigarette smoke components is a main cause leading to atherosclerosis, COPD (Chronic Obstructive Pulmonary Disease), and cancer. The cultures of vascular endothelial cells treated with cigarette smoke extracts develop typical symptoms associated with atherosclerosis, like cytoskeletal disintegration, the breakdown of cell-cell junctions and low viability through necrotic cell death. The use of compounds such as atorvastatin and N-acetyl cysteine improved cell viability up to a level.

It is widely known that tobacco smoke contains mutagenic and carcinogenic compounds, which cause substantial morbidity and mortality to smokers. The examples of such substances include polycyclic aromatic hydrocarbons (PAH) and nitrosamines. The polycyclic aromatic hydrocarbons appear to cause toxicity by intercalating within the DNA molecules. The nitrosamines are electrophilic alkylating agents, which are potent carcinogens. The nitrosamines are not present in fresh or green tobaccos and are not formed during combustion. They are instead formed by reactions involving free nitrate during processing and storage of tobacco or by the post-inhalation, metabolic activation of secondary amines present in the tobacco smoke.

The attempts to reduce the amount of toxic and mutagenic compounds that reach the smoker include tobacco smoke filters positioned between the burning tobacco and the smoker. The conventional filters are made of cellulose acetate, with or without activated charcoal. These conventional filters, however, are only partially effective in reducing the amount of toxic and mutagenic compounds reaching the smoker. Further, these conventional filters disadvantageously remove the flavoring compounds thereby decreasing an acceptance by the smoker.

There have been filter absorbents that are intended to bind nitrogen monoxide (NO) from tobacco smoke. The ferrous ions capable of forming a complex with nitrogen monoxide is attached with thiol-containing low molecular weight ligands to form complexes which are impregnated as aqueous solution on the conventional filter material such as cellulose based filters. The metal based smoke filters have also been produced. The catalytic activity of rare earth metals, zirconium and manganese oxide or hydroxides are used to eliminate toxic compounds such as carbon monoxide, $NO_x$, nitrosamines, aldehydes, aromatic amines, sulfates and phosphor sulfonates as well as the metals such as cadmium, nickel and zinc from the cigarette smoke. The tobacco smoke filters that comprise a porphyrin-ring metal complex, as found in hemoglobin are capable of inactivating the oxidative radicals such as $O_2^-$, $H_2O_2$, NO and other organic radicals, such as isoprene-, peroxyl-, alkoxyl-radicals, that are found in cigarette smoke. Further, an impregnation of filter materials that contain mercaptoethane sulfonic acid and results in a limited reception of the compound by the filter material which is capable of reducing the formaldehyde, acrolein and hydrocyanic acid content of cigarette smoke by 10 to 25% have been disclosed. An inorganic filter comprising thioalkylsilyl groups covalently bound to an inorganic molecular sieve substrate, e.g. zeolite, for the absorption of mercury and cadmium from cigarette smoke is also disclosed. But none of the prior art methods describe a cigarette filter that is efficiently removes the toxic compounds from a cigarette smoke without a removal of flavouring compounds from the cigarette thus providing an acceptance to a user.

Hence there is a need for an improved filter for smoking devices that substantially removes toxic and mutagenic compounds from tobacco smoke without losing the user's acceptance.

The above-mentioned shortcomings, disadvantages and problems are addressed herein and which will be understood by reading and studying the following specification.

OBJECTIVES OF THE EMBODIMENTS

The primary object of the embodiments herein is to provide an electrospun fiber mat cigarette filter for removing toxic compounds from cigarette smoke.

Another object of the embodiments herein is to provide a simple and easy to use cigarette filter that leads to a user's compliance.

Yet another object of the embodiments herein is to provide a cigarette filter that is inexpensive to manufacture.

Yet another object of the embodiments herein is to provide a cigarette filter that removes toxic and mutagenic compounds from tobacco smoke and thus allows a passage to the flavoring compounds of the cigarette.

Yet another object of the embodiments herein is to provide a cigarette filter made up of natural or synthetic polymacrocycles that remove the toxic compounds from the cigarette smoke.

Yet another object of the embodiments herein is to provide a cigarette filter that is made up of engineered biological or synthetic macrocycles or poly macrocycles.

Yet another object of the embodiments herein is to provide a cigarette filter absorbs the mutagenic and toxic compounds from a cigarette smoke when a cigarette smoke passes through the filter.

Yet another object of the embodiments herein is to provide a cigarette filter that is made up of nanofibers where the nanofibers have an increased surface to volume ratio, which helps in greater absorbance of the mutagenic and toxic compounds.

Yet another object of the embodiments herein is to provide a method of synthesizing an electrospun fiber mat cigarette filter for removing toxic compounds from cigarette smoke.

Yet another object of the embodiments herein is to provide a method of synthesizing a cigarette filter that is electrospun to produce nanofibers in the form of a felt or a fiber mat.

Yet another object of the embodiments herein is to provide a method of synthesizing a cigarette filter that is woven with the conventional cigarette filters also.

Yet another object of the embodiments herein is to provide a method of synthesizing a cigarette filter in which biological substances are attached to the surface of the nanofibers.

Yet another object of the embodiments herein is to provide a cigarette filter where the biological macrocycles and polymacrocycles such as polyhemoglobin (with no toxicity) increase the absorbency of gaseous compounds by the nanostructures or nanofibers formed after electrospinning.

These and other objects and advantages of the embodiments herein will become readily apparent from the following detailed description taken in conjunction with the accompanying drawings.

SUMMARY

The embodiments herein provide a cigarette filter and a method of synthesizing the same. According to one embodiment herein, the electrospun fiber mat cigarette filter for removing toxic compounds from a cigarette smoke comprises a biological macromolecule, a plurality of additives, a solvent and an acceptable polymeric carrier. The biological macromolecule comprises polynuclear complexes with polymetal ions and a combination thereof. The polynuclear complexes are polyporphyrin rings and the polymetal ions include ferrous ions ($Fe^{2+}$), cuprous ions ($Cu^{2+}$), manganese ions ($Mg^{2+}$) and zinc ions ($Zn^{2+}$). The biological macromolecule is selected from a group consisting of an engineered polyhemoglobin and/or chlorophyll.

According to another embodiment herein, the engineered polyhemoglobin includes at least one stromal-free hemoglobin tetramer ($Hb_4$). The stromal-free hemoglobin tetramer ($Hb_4$) is cross-linked within or with at least one another heme containing hemoglobin monomer (Hb) to yield a macro-molecular compound. The macro-molecular compound has a general formula of poly$(Hb)_n$. The Hb is a hemoglobin monomer and n is 4 to 60.

According to an embodiment herein, the biological macromolecule further comprises heterocyclic macrocycles. The heterocyclic macromolecules comprise corrins, corrinoids, chlorins, porphyrin and bacteriochlorin.

According to an embodiment herein, the acceptable polymeric carrier comprises homopolymers and copolymers of the homopolymers, organic or inorganic hybrid polymers, wherein the homopolymers further comprises polyurethanes, polyacrylonitrile, polyvinyl alcohol (PVA), polylactic acid, polyethylene-co-vinyl acetate, polycarbonate, poly(iminocarbonates), polymethacrylates, poly(alkyl methacrylic acids), polyacrylates, poly(alkyl acrylic acids), poly(N,N'-diethylaminoethyl methacrylate), poly(N,N'-dialkylaminoalkyl acrylamides), poly(ethylene oxide) (PEO), polyethylene terephthalate, polystyrene, polyvinyl chloride (PVC), poly vinyl phenol, polyacrylamide, poly(N-alkyl acrylamides), poly lactic-co-glycolic acids, polycaprolactone, poly (2-hydroxyethyl methacrylate), poly(vinylidene fluoride), poly(vinylidene chloride), poly(ethylene glycol) (PEG), polyvinyl pyrrolidone, polyethylene, polypropylene, poly(3-hydroxybutyrate), poly(ortho esters), polyanhydrides, poly (ether-ester) azopolymers, poly(dimethyl siloxane), and poly (phosphazenes). The organic or inorganic hybrid polymers comprises ethylene oxide-polypropylene glycol condensates, polystyrene, polyamide, polyacrylonitrile, polyimide, poly vinylidene chloride (PVDC), poly tetra-fluoro ethylene (PTFE), polyester, polysulfone, polyolefin, polysilsesquioxane, silicone, epoxy, polyketone, polyether, polyamine, polyphosphazene, polysulfide, polybutadiene, polyethylene, cellulose, polylactones, proteins, poly(vinyl pyrrolidone), and poly(styrene sulfonate), or combinations thereof. The polymers comprise preferably water-soluble polymers or hydrolyzable polymers. The water-soluble polymers or hydrolyzable polymers are selected from a group consisting of poly (ethylene oxide) (PEO), polylactide (PLA), polyglycolide (PGA), polycaprolactone (PCL), polyhydroxybutyrate (PHB), polyhydroxyvalerate (PHBV), polyvinyl alcohol (PVA) cellulose, cellulose acetate, chitosan, collagen, DNA, fibrinogen, and fibronectin. The acceptable polymeric carrier is poly(ethylene oxide) (PEO).

According to an embodiment herein, the solvent comprises water, 1,1,1,3,3,3-hexafluoropropanol, tetrafluoromethane, chloroform, methanol, N,N-dimethylacetamide, N,N-dimethylformamide, tetrahydrofuran, formamide, toluene, 1-propanol, 2-propanol, ethanol, dichloromethane, formamide, dimethylacetamide, methylene chloride, chlorobenzene, chloroform, carbon tetrachloride, chlorobenzene, chloroacetonitrile, carbon disulfide, dimethylsulfoxide, benzene, styrene, acetonitrile, tetrahydrofuran, acetone, methylethylketone, dioxanone, cyclohexanone, cyclohexane, dioxane, 1-nitropropane, tributylphosphate, ethyl acetate, phosphorus trichloride, butanol, glycol, phenol, diethylene glycol, polyethylene glycol, and 1,4-butanediol. The solvent is a solution of ethanol in water.

According to an embodiment herein, the plurality of additives comprises chitosan, active charcoal, anti-oxidants, vitamins, nucleic acids, drugs, peptides, proteins, vegetable oil, humectants, polysaccharides, dextran, gum arabic, pectin, fluid gelatin and hydroxyethyl starch.

According to an embodiment herein, the nanofibers diameter between 50 nm to 100000 nm specially an average fiber diameter of less than 500 nm.

According to another embodiment herein, the method of synthesizing the electrospun fiber mat cigarette filter for removing toxic compounds from a cigarette smoke comprises obtaining an engineered biological macromolecule. The prepared biological macrocycle is polymerized to form a polymerized engineered biological macromolecule. The polymerized biological macromolecule is mixed with an additive, a solvent and an acceptable polymeric carrier to form a mixture. The mixture is electrospun in presence of an abruptly asymmetric electric field to form an electrospun fiber mat. The engineered biological macromolecule is selected from a group consisting of an engineered polyhemoglobin and/or chlorophyll. The polymerized engineered biological macromolecule comprises a polymerized engineered polyhemoglobin and/or chlorophyll. The acceptable polymeric carrier is poly(ethylene oxide) (PEO) and the solvent is a solution of ethanol in water. The abruptly asymmetric electric field is 1000V-80000V and the electrospun fiber mat is made up of networks of plurality of nanofibers.

According to an embodiment herein, the step of obtaining the engineered polyhemoglobin further comprises separating a plurality of red blood cells (RBCs) from plasma by centrifugation. The plurality of RBCs is separated from a fresh sheep blood. The separated RBCs are washed for at least three times. The separated RBCs are washed using a NaCl solution with a concentration of 0.9%. The washed RBCs are centrifuged. The washed RBCs are centrifuged for 10 minutes at 4000 g. The centrifuged RBCs are lysed. The centrifuged RBCs are lysed with 3 to 4 volumes of pyrogen free water. The centrifuged RBCs are lysed to rupture the intact cell walls of the centrifuged RBCs to separate the hemoglobin. The lysed RBCs are shaken vigorously and extracted. The shaken RBCs are extracted with an ice-cold toluene and the stroma is separated.

According to an embodiment herein, the step of forming the polymerized engineered polyhemoglobin further comprises reacting the hemoglobin kept in a phosphate buffer with gluteraldehyde to form a solution. The hemoglobin is kept at 4° C. The phosphate buffer includes lysine monohydrochloride. The formed solution is equilibrated with nitrogen for 18 hours to form an equilibrated solution. The formed solution is equilibrated to remove an air contamination. The equilibrated solution is crosslinked by adding a lysine solution in an excess quantity to form a cross-linked solution. The cross linked solution is oxygenated to form an oxygenated solution and the oxygenated solution is dialysed. The oxygenated solution is dialysed to remove an unbound glutaredehyde and an excess of the lysine solution.

According to an embodiment herein, the step of forming the chlorophyll further comprises mixing a homogenized green tobacco with a cold ethanol in a vessel. The cold ethanol is used with a concentration of 95% and the homogenized green tobacco is mixed with the cold ethanol in a ratio of 2:1. The vessel is covered with a perforated aluminium foil. The covered vessel is placed over a steam bath. The placed vessel occasionally swirled till the ethanol boils. The content of the vessel are filtered with a filter paper. The filter paper is Whatman no. 1 filter paper. The vessel is rinsed with a hot ethanol and further the hot ethanol is added to the filter paper.

According to an embodiment herein, the step of electrospinning further comprises a use of two electrodes bearing an opposite electric charges. The one electrode connect to a nozzle that containing: the biological macromolecule consisting of an engineered polyhemoglobin and/or chlorophyll; a plurality of additives; a solvent; and an acceptable polymeric carrier and the second electrode is placed onto a collector of an electro spinning machine.

According to an embodiment herein, the solvent has a viscosity in a range of 1-20 poise and the solvent has a surface tension in a range of 30 and 60 dynes/cm.

According to an embodiment herein, the biological macromolecule comprises heterocyclic macrocycles, and the heterocyclic macrocycles comprises corrins, corrinoids, chlorins, porphyrin and bacteriochlorin.

According to one embodiment herein, a porphyrin ring is a classic porphyrin ring containing compound is replaced with an engineered polyhemoglobin and engineered polymetal ions ($Fe^{2+}$, $Cu^{2+}$, $Mg^{2+}$, $Zn^{2+}$) in a complex with polyporphyrin rings in a nano-dimension state and assembling of the biological substance to form heterogeneous or homogeneous networks from engineered Polyhemoglobin or engineered Polyporphyrin rings without toxicity for inhalation. According to another embodiment herein, an electrospun macrocycles with the biological substances provide network of engineered polymetal ions, which are in complex with network of the biological macrocycles and acceptable polymeric carrier alone or enrich conventional cigarette filter.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1:
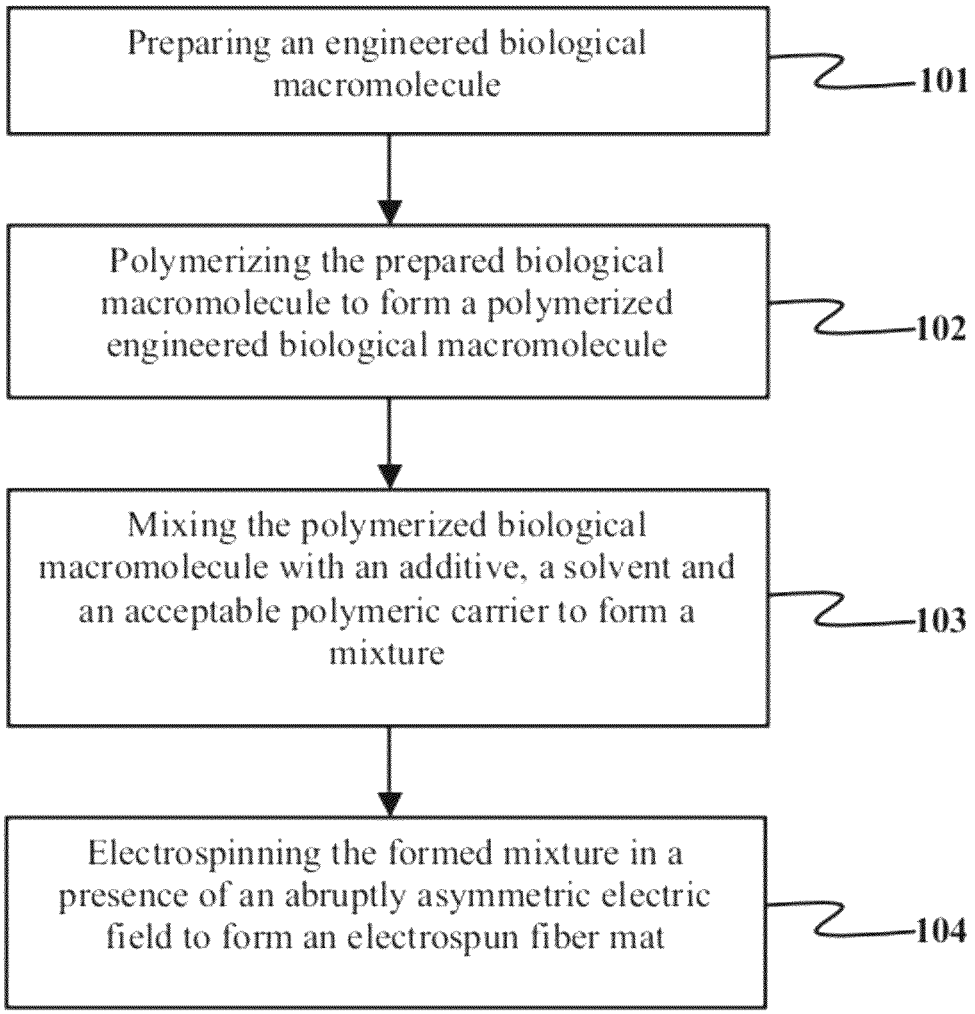
FIG. 1 shows a flow chart showing the various steps involved in the method of synthesizing the electrospun fiber mat cigarette filter for removing toxic compounds from a cigarette smoke, according to an embodiment herein.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

DETAILED DESCRIPTION OF THE EMBODIMENTS

In the following detailed description, a reference is made to the accompanying drawings that form a part hereof, and in which the specific embodiments that may be practiced is shown by way of illustration. The embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The various embodiments herein provide a cigarette smoke filter material and a method of manufacturing the same. The method refers to the enrichment of convention filters with biological substances of engineered the polynuclear complexes with polymetal ions of biological macrocycles, either separately or in combinations. The enrichment of the conventional filters with the biological substances provides a network of engineered polynuclear complexes of the biological macrocycles. The embodiments herein also provide electro spun macrocycles with electrospun biological substances to provide networks of engineered polymetal ions complexed with network of the biological macrocycles and acceptable polymeric carrier alone or enriched with the conventional cigarette filters. The electro-processed macrocycles are combined with other molecules to allow an increased inactivation of both the particulate and the vapor-phase toxic and mutagenic compounds of a tobacco smoke.

According to an embodiment herein, nontoxic polymerized hemoglobin is provided and the terms "polymerized hemoglobin", "cross-linked hemoglobin" and "macromolecular hemoglobin" are hereafter referred to as "polyhemoglobin", and the terms "polymerized hemoglobin", "cross-linked hemoglobin", "macro-molecular hemoglobin", and "polyhemoglobin" are considered as equivalents.

Hemoglobin is the oxygen-carrying pigment and predominant protein in the red blood cells. Hemoglobin outside the red blood cell has toxic effect in human body. Polyhemoglobin is formed by crosslinking hemoglobin molecules intermolecularly and intra-molecularly with glutaraldehyde and other acceptable polymerization methods to produce soluble polyhemoglobin. The polyhemoglobin macrocycle molecule is not only nontoxic but also used as a potential blood substitute. Each hemoglobin molecule is made up of four heme groups surrounding a globin group. Heme contains iron and gives a red color to the molecule. A heme group consists of an iron (Fe) ion (charged atom) held in a heterocyclic ring, known as a porphyrin. The porphyrin ring consists of four pyrrole molecules cyclically linked together by methene bridges with the iron ion bound in the center. The iron ion, which is the site of oxygen binding, coordinates with the four nitrogen atoms in the centre of the ring, which lie in one plane. Hemoglobin and the like molecules are also found in many invertebrates, fungi and plants. In these organisms, hemoglobin may carry oxygen or it may act to transport and regulate other things such as carbon dioxide, nitric oxide, hydrogen sulfide and sulfide.

Chlorophyll has anti-inflammatory, antioxidant and wound-healing properties and extracted from leaf of plant. Chlorophyll is a good source of antioxidant nutrients. Chlorophyll is an efficient deliverer of magnesium and helps the blood to carry oxygen to the cells and tissue. Chlorophyll assists in the chelation of heavy metals. Chlorophyll has been studied for its potential in stimulating tissue growth and in stimulating red blood cells in connection with oxygen supply. Chlorophyll also removes carbon dioxide and carbon monoxide. Chlorophyll reduces the binding of carcinogens to DNA in the liver and other organs and has some anti-atherogenic activity. Chlorophyll along with chlorophyllin has some antimutagenic and anticarcinogenic potential that help protect against toxins and ameliorate drug side effects. Chlorophyll has been used traditionally to improve bad breath.

The biological substances are engineered polynuclear complexes with polymetal ions of biological macromolecules. The polymetal ions include $Fe^{2+}$, $Cu^{2+}$, $Mg^{2+}$, and $Zn^{2+}$ ions. According to another embodiment herein, an electrospun macrocycles with the biological substances provide network of engineered polymetal ions complexed with network of the biological macrocycles and acceptable polymeric carrier alone or enriched conventional cigarette filter.

According to an embodiment herein, a cigarette filter comprises a reagent. The reagent comprises essentially of at least one of the engineered biological macrocycles with polynuclear complexes, either separately or in combinations and electro spinning the compounds with acceptable polymeric carrier and solvent to produce nano-dimensional structures. According to another embodiment herein, the reagent comprises nanofibers that have a diameter in nano dimensions in the form of networks with engineered polymetal ions complexes. The metals are iron, copper, magnesium and zinc.

The biological macrocycles comprises heterocyclic macrocycles further comprising corrins, corrinoids, chlorins, porphyrin and bacteriochlorins. The engineered polynuclear complexes of biological macrocycles with polymetal ions such as $Fe^{2+}$, $Cu^{2+}$, $Mg^{2+}$, $Zn^{2+}$. The biological macrocycles crosslink to form polyporphyrins, polychlorins super molecule macrocycles or crosslink together or crosslink with another macrocycles or combination thereof.

According to another embodiment herein, the cigarette filter comprises nanofibers with biological or synthetic substances of engineered polynuclear complexes with polymetal ions of biological or synthetic macrocycles, either separately or in combinations. The poly metal ions comprise $Fe^{2+}$, $Cu^{2+}$, $Mg^{2+}$, and $Zn^{2+}$. The enrichment of the conventional filters with the biological substances provides a network of engineered polynuclear complexes of the biological or synthetic macrocycles. According to another embodiment herein, the electrospun macrocycles with the biological or synthetic substances provide network of engineered polymetal ions that are in complex with network of the biological or synthetic macrocycles and acceptable polymeric carrier alone or enriched with conventional cigarette filter and used as a part of cigarette filter that does not come in contact to a human body i.e. lips or mucosa.

According to another embodiment herein, the method of synthesizing the electrospun cigarette filter comprises an extraction of the macrocycles that are produced over synthesis of macrocycles from a biological source. Then polymerizing the extracted macrocycles in a nontoxic solvent combined with a polymer that is acceptable for electro spinning processes to form a solution. The formed solution is electro spun using an electrospinning machine to produce the electrospun nanofibers. The produced nanofibers according to an embodiment herein are woven with conventional cigarette filters or are either used alone.

The effectiveness of the biological cigarette filter is apparent in retaining and neutralizing the Nitrous Oxide (NO), which has been implicated in toxic reactions both in lung cells and in lung fluids. The retention of the free radicals by the biological cigarette filter according to the embodiments herein implies that there is a reduction of the oxidative stress in the alveolar macrophages, which is caused by conventional cigarette smoke. In the conventional cigarette the aldehydes and trace elements contained in the smoke are more than those passed through a biological filter according to the embodiment herein and the filter inhibits 90% of nitroso compounds of the cigarette smoke. The cigarette smoke after getting filtered from the cigarette filter according to the embodiments herein is free from the substances that cause oxidative stress on lung macrophages. The use of a biological filter shows a decrease in $H_2O_2$ production by 90% as compared to conventional filters.

According to an embodiment herein, the biofilter or the cigarette filter is electrospun simultaneously with the produced commercial filter on or beside the commercial cellulose fibers comprising one or more electrospun natural or synthetic polymacrocycles are formed as felt network concurrently. The filter according to the embodiments herein is smaller and is of a lesser volume than the commercial filter. The filter according to the embodiments herein is used either separately or in combinations with commercial filters.

The free hemoglobin is a toxic component for human body but polyhemoglobin is non-toxic. In the molecule of engineered polyhemoglobin cross-linking occur either intramolecularly and/or intermolecularly to make a supermolecule that absorbs toxic elements. According to another embodiment herein, the use of electrospun polyhemoglobin and other macrocycle that are arranged in nano dimensions and provide an increased surface area to volume ratio that provides for an increased reaction between the nano-arranged molecule and the toxic component in the cigarette filter. The electro processed polynuclear complexes of biological macrocycles chemically react with a gaseous component and inactivate both particulate and vapor-phase toxic and mutagenic compounds of tobacco smoke to remove the components from the smoke stream.

According to an embodiment herein, the polyporphyrin comprises a polyheme or polyhemoglobin or poly of biological macrocycles selected from the group consisting of copper ions in a complex with porphyrin rings, magnesium ions in a complex with porphyrin rings, zinc ions in a complex with porphyrin rings, and combinations thereof. The polynuclear complexes of biological macrocycles combined with the various compounds in order to allow increased inactivation of both particulate and vapor-phase toxic and mutagenic compounds of tobacco smoke and electro spinning of the polynuclear complexes of biological macrocycles combined with other molecules with acceptable polymeric carrier to form electro spun nanofibers mat in the presence of an asymmetric abruptly electric field as heterogeneous or homogeneous networks. The nanofibers that are electro spun transform to fiber mat in the presence of an abruptly asymmetric electric field as heterogeneous or homogeneous networks.

According to an embodiment herein, the various compounds are added in the form of additives to allow an increased inactivation of both the particulate and the vapor-phase toxic and mutagenic compounds of the tobacco smoke. The additives comprises chitosan, active charcoal, anti-oxidant, vitamin, nucleic acid, drug, peptide, protein, vegetable oil, humectants, polysaccharides, dextran, gum arabic, pectin, fluid gelatin and hydroxyethyl starch.

According to an embodiment herein, a fabrication of nanofibers comprises an electrospinning of compounds such as polymer and solvent and polynuclear complexes of biological macrocycles. The polynuclear complexes of biological macrocycles as particles attached to the surface of the acceptable polymeric carrier transform to nanofibrous shape. The final product according to the embodiments herein, is of two kinds of nanofibers that are interlaced together. The mixture of engineered biological macrocycles and carrier materials are integrated into one kind of fibers containing both components.

According to one embodiment herein, the polynuclear complexes of macrocycles alone or combined with the various compounds are electro spin to produce a mat of fibers for cigarette filter. The polynuclear complexes of macrocycles alone or combined with other molecules are electro spun for enriching the conventional cigarette filter. According to an embodiment herein, the electro-spun nanofibers are transformed to a fiber mat and attached to the conventional cigarette filter medium in the presence of an abruptly asymmetric electric field. According to another embodiment herein the polynuclear complexes of macrocycles are electro processed either separately or in combinations with the same or with another nozzle of the electro-spinning machine.

According to an embodiment herein, the acceptable polymeric carrier comprises polyurethanes, polyacrylonitrile, polyvinyl alcohol (PVA), polylactic acid, polyethylene-co-vinyl acetate, polycarbonate, poly(iminocarbonates), polymethacrylates, poly(alkyl methacrylic acids), polyacrylates, poly(alkyl acrylic acids), poly(N,N'-diethylaminoethyl methacrylate), poly(N,N'-dialkylaminoalkyl acrylamides), poly (ethylene oxide) (PEO), polyethylene terephthalate, polystyrene, polyvinyl chloride (PVC), poly vinyl phenol, polyacrylamide, poly(N-alkyl acrylamide)s, poly lactic-co-glycolic acids, polycaprolactone, poly(2-hydroxyethyl methacrylate), poly(vinylidene fluoride), poly(vinylidene chloride), poly(ethylene glycol) (PEG), polyvinyl pyrrolidone, polyethylene, polypropylene, poly(3-hydroxybutyrate), poly (ortho esters), polyanhydrides, poly(ether-ester) azopolymers, poly(dimethyl siloxane), poly(phosphazene)s, other copolymers of the above homopolymers, and ethylene oxide-polypropylene glycol condensates, polystyrene, polyamide, polyacrylonitrile, polyimide, PVDC, PTFE, polyester, polysulfone, polyolefin, polysilsesquioxane, silicone, epoxy, polyketone, polyether, polyamine, polyphosphazene, polysulfide, polybutadiene, polyethylene, cellulose, polylactones, proteins, poly(vinyl pyrrolidone), and poly(styrene sulfonate) organic/inorganic hybrid polymer, or combinations thereof; especially, polymers include water-soluble polymers, or hydrolyzable polymers, such as poly(ethylene oxide) (PEO), polylactide (PLA), polyglycolide (PGA), polycaprolactone (PCL), polyhydroxybutyrate (PHB), polyhydroxyvalerate (PHBV), polyvinyl alcohol (PVA) cellulose, cellulose acetate, chitosan, collagen, DNA, fibrinogen, fibronectin but are not limited to the above group.

According to another embodiment herein, the solvent comprises water, 1,1,1,3,3,3-hexafluoropropanol, tetrafluoromethane, chloroform, methanol, N,N-dimethylacetamide, N,N-dimethylformamide, tetrahydrofuran, formamide, toluene, 1-propanol, 2-propanol, ethanol, dichloromethane, formamide, dimethylacetamide, methylene chloride, chlorobenzene, chloroform, carbon tetrachloride, chlorobenzene, chloroacetonitrile, carbon disulfide, dimethylsulfoxide, benzene, styrene, acetonitrile, tetrahydrofuran, acetone, methylethylketone, dioxanone, cyclohexanone, cyclohexane, dioxane, 1-nitropropane, tributylphosphate, ethyl acetate, phosphorus trichloride, butanol, glycol, phenol, diethylene glycol, polyethylene glycol, 1,4butanediol, other acid, other alcohol, other ester alcohol, other ketone, other ester, other aromatic, other amide, and other chlorinated hydrocarbon.

According to one embodiment herein, the nanofibers are produced by electrospinning method and including the engineered biological substances including polynuclear complexes of biological macrocycles with polymetal ions. The engineered polynuclear complexes of biological macrocycles with polymetal ions ($Fe^{2+}$, $Cu^{2+}$, $Mg^{2+}$, $Zn^{2+}$) complexes and nanofibers of engineered polymetal ions ($Fe^{2+}$, $Cu^{2+}$, $Mg^{2+}$, $Zn^{2+}$) complexes with great diameter network reduce the toxicity of the toxic and mutagenic compounds of cigarette smoke.

According to another embodiment herein, an increase in the surface to volume ratio in the nanostructures and high capability of contact surface nanostructures cause different materials of biological absorbant to connect to the nanofibers. The increased surface area of the nanofibers substantially removes toxic and mutagenic compounds from tobacco smoke without resistance for the passing of the tobacco smoke. Biological substances of engineered polynuclear complexes with polymetal ions ($Fe^{2+}$, $Cu^{2+}$, $Mg^{2+}$, $Zn^{2+}$) of biological macrocycles comprising hemoglobin, directly as particles can be attached to the surface of the nanofibers or biological substances of engineered the polynuclear complexes with polymetal ions ($Fe^{2+}$, $Cu^{2+}$, $Mg^{2+}$, $Zn^{2+}$) of biological macrocycles comprising hemoglobin is electrospun with nanofibers.

A macrocycle is a cyclic macromolecule or a macromolecular cyclic portion of a molecule or any molecule containing a ring of seven, fifteen, or any arbitrarily large number of atoms to be macrocyclic. A macrocycle as a cyclic molecule with three or more potential donor atoms in a ring of at least nine atoms. In this sense, a macrocycle is heterocyclic however not all heterocycles are macrocycles. An organic macrocycle containing a large ring, that is, a closed chain of 12 or more carbon atoms; examples include crown ethers, cryptands, spherands, carcerands, cyclodextrins, cyclophanes, and calixarenes. To synthesize macrocycles at high concentrations, the transition metals, with ability to gather and dispose of ligands in a given predictable geometry and arranged as a "template effect". By binding to the linear molecule, to influence its geometry, a metal "template" can accelerate either the intramolecular and/or the intermolecular reaction. The "template effect" can be divided into two effects: the kinetic template effect that is the directive influence of the metal ion and controls the stearic course of a sequence of stepwise reactions. In cases where the thermodynamic template effect operates, the metal ion perturbs an existing equilibrium in an organic system and the required product is produced often in high yield as a metal complex. Heme, the active site in the hemoglobin (a porphyrin containing iron) extract from biological source (blood) and chlorophyll, the green photosynthetic pigment (contains a chlorin ring) extract from biological source (plant).

Chlorophyll is the green pigment, which is responsible for the green color in most plants. Chlorophyll is capable of channeling the energy of sunlight into chemical energy through the process of photosynthesis. Chlorophyll is a chlorin pigment, which is structurally similar to and produced through the same metabolic pathway as other porphyrin pigments such as heme portion of hemoglobin. At the center of the chlorin ring is a magnesium ion.

Since the biological substances that are enriched in the convention filters which comprise free hemoglobin and/or metal ions (such as $Fe^{2+}$, $Cu^{2+}$, $Mg^{2+}$, $Zn^{2+}$) in complex with a classic porphyrin ring are not safe for inhalation. So, in the embodiments herein, the classic porphyrin ring is replaced with engineered porphyrin rings. The engineered porphyrin rings comprise polyhemoglobin and engineered polymetal ions in complex with polyporphyrin rings. The polymetal ions include ferrous ions ($Fe^{2+}$), cuprous ions ($Cu^{2+}$), manganese ions ($Mg^{2+}$) and zinc ions ($Zn^{2+}$). The engineered porphyrin rings comprising polyhemoglobin and engineered polymetal ions in complex with polyporphyrin rings are in the nano-dimensional stage. The engineered porphyrin rings comprising polyhemoglobin and engineered polymetal ions in complex with polyporphyrin rings are assembled to form homogeneous and heterogeneous networks, which are without any toxicity for inhalation. The biological substance comprises networks of engineered polyhemoglobin and engineered polyporphyrin rings each consisting of an assembly of at least 4-5 Hb molecules and/or metal ions in complex with polyporphyrin rings. According to one embodiment herein, the polyhemoglobin comprises at least one stromal-free hemoglobin tetramer, $Hb_4$, cross-linked within the tetramer or with at least one other heme containing hemoglobin monomer, Hb, to yield the macro-molecular compound of the general formula poly$(Hb)_n$ wherein Hb is the hemoglobin monomer and n is 4 to 60.

According to one embodiment, the nanofibers are formed in the presence of an applied electric field waveform producing the abruptly varying electric field, and nanofibers have an average fiber diameter of less than 500 nm.

According to one embodiment herein, an electrospun macrocycles comprising an electrospun fiber of acceptable polymeric carrier integrated with macrocycles, also the one macrocycle or more substances is another macrocycles, chitosan, active charcoal, anti-oxidant, vitamin, nucleic acid, drug, peptide, protein, vegetable oil, humectants, the one or more substances are dispersed with the carrier in the fiber, and the electro processed macrocycles of said, present in a matrix or in a solvent. The polynuclear complexes of biological macrocycles dissolved in an organic or aqueous solvent.

The fibers and nanofibers produced according to the embodiments herein, include acrylonitrile or butadiene copolymer, cellulose, cellulose acetate, chitosan, collagen, DNA, fibrinogen, fibronectin, nylon, poly(acrylic acid), poly (chloro styrene), poly(dimethyl siloxane), poly(ether imide), poly(ether sulfone), poly(ethyl acrylate), poly(ethyl vinyl acetate), poly(ethyl-co-vinyl acetate), poly(ethylene oxide), poly(ethylene terephthalate), poly(lactic acid-co-glycolic acid), poly(methacrylic acid) salt, poly(methyl methacrylate), poly(methyl styrene), poly(styrene sulfonic acid) salt, poly(styrene sulfonyl fluoride), poly(styrene-co-acrylonitrile), poly(styrene-co-butadiene), poly(styrene-co-divinyl benzene), poly(vinyl acetate), poly(vinyl alcohol), poly(vinyl chloride), poly(vinylidene fluoride), polyacrylamide, polyacrylonitrile, polyamide, polyaniline, polybenzimidazole, polycaprolactone, polycarbonate, polydimethylsiloxane-co-polyethyleneoxide, polyetheretherketone, polyethylene, polyethyleneimine, polyimide, polyisoprene, polylactide, polypropylene, polystyrene, polysulfone, polyurethane, polyvinylpyrrolidone, proteins, [styrene-b-(ethylene-co-butylene)-b-styrene] (SEBS) copolymer, silk, and styrene or isoprene copolymer.

According to another embodiment herein, polymer blends can also be produced as long as the two or more polymers are soluble in a common solvent. The polymers comprises poly (vinylidene fluoride)-blend-poly(methyl methacrylate), polystyrene-blend-poly(vinylmethylether), poly(methyl methacrylate)-blend-poly(ethyleneoxide), poly(hydroxypropyl methacrylate)-blend poly(vinylpyrrolidone), poly(hydroxybutyrate)-blend-poly(ethylene oxide), protein blend-polyethyleneoxide, polylactide-blend-polyvinylpyrrolidone, polystyrene-blend-polyester, polyester-blend-poly(hydroxyethyl methacrylate), poly(ethylene oxide)-blend poly(methyl methacrylate), poly(hydroxystyrene)-blend-poly(ethylene oxide).

According to an embodiment herein, suitable hydrophilic polymers comprises linear poly(ethylenimine), cellulose acetate and other grafted cellulosics, poly(hydroxyethylmethacrylate), poly(ethyleneoxide), and polyvinylpyrrolidone. Suitable polymers that are at least weakly hydrophobic comprises acrylics and polyester such as, poly(caprolactone), poly(L-lactic acid), poly(glycolic acid), and similar co-polymers of these acids. The polymer solutions may optionally be applied in a sterile condition.

According to another embodiment herein, matrix polymers comprises Nylon 6-6, Nylon 6-10, and other nylons, polyurethanes, polyacrylonitrile, polyvinyl alcohol, polylactic acid, polyethylene-co-vinyl acetate, polycarbonate, poly(iminocarbonate)s, polymethacrylates, poly(alkyl methacrylic acid)s, polyacrylates, poly(alkyl acrylic acid)s, poly(N,N'-diethylaminoethyl methacrylate), poly(N,N'-dialkylaminoalkyl acrylamides), poly(ethylene oxide) (PEO), polyethylene terephthalate, polystyrene, polyvinyl chloride, poly vinyl phenol, polyacrylamide, poly(N-alkyl acrylamide)s, poly lactic-co-glycolic acids, polycaprolactone, poly(2-hydroxyethyl methacrylate) (polyHEMA), poly(vinylidene fluoride), poly(vinylidene chloride), poly(ethylene glycol) (PEG), polyvinyl pyrrolidone, polyethylene, polypropylene, poly(3-hydroxybutyrate), poly(ortho esters), polyanhydrides, poly(ether-ester) azopolymers, poly(dimethyl siloxane), poly(phosphazene)s, other copolymers of the above homopolymers (e.g. poly(methacrylic acid-co-ethylene glycol), and others.

FIG. 1 shows the flow chart showing the various steps involved in the method of synthesizing the electrospun fiber mat cigarette filter for removing toxic compounds from a cigarette smoke, according to an embodiment herein. With respect to FIG. 1, an engineered biological macromolecule is preparing (101). Then, the prepared biological macromolecule is polymerized to form a polymerized engineered biological macromolecule (102). The polymerized biological macromolecule is mixed with an additive, a solvent and an acceptable polymeric carrier to form a mixture (103). The formed mixture is electrospun in a presence of an abruptly asymmetric electric field to form an electrospun fiber mat (104). The engineered biological macromolecule is selected from a group consisting of an engineered polyhemoglobin and/or chlorophyll. The engineered biological macromolecule is selected from a group consisting of an engineered polyhemoglobin and/or chlorophyll. The acceptable polymeric carrier is poly(ethylene oxide) (PEO) and the solvent is a solution of ethanol in water. The abruptly asymmetric electric field is 1000V-80000V and the electrospun fiber mat is made up of networks of plurality of nanofibers.

Figure 2:
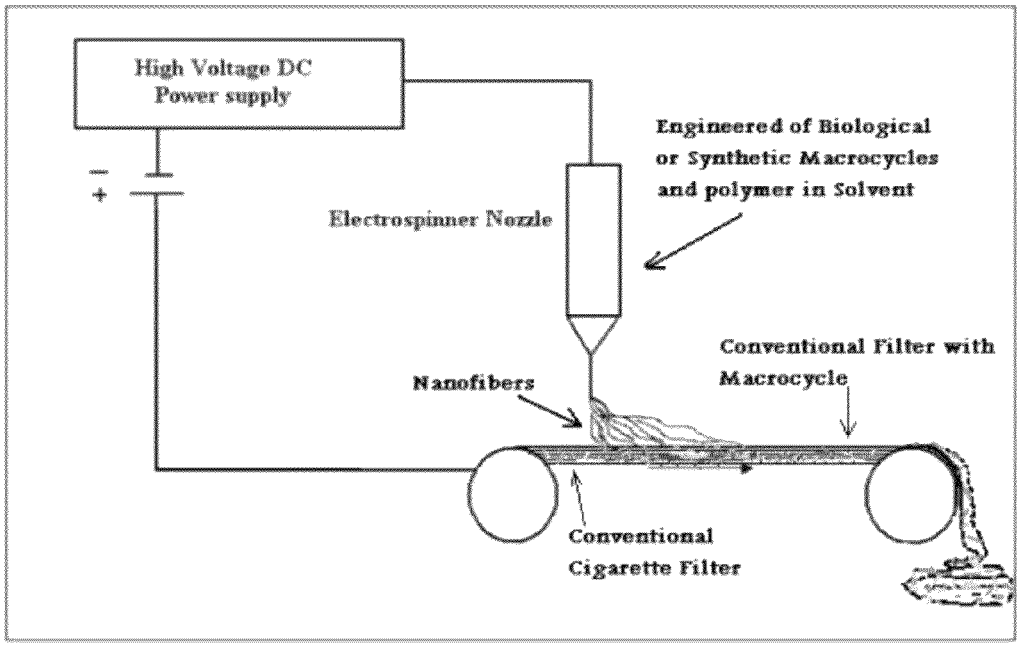
FIG. 2 is a schematic diagram showing the synthesis of the cigarette filter, according to an embodiment herein.

FIG. 2 is the schematic diagram showing the synthesis of the cigarette filter, according to an embodiment herein. With respect to FIG. 2, the biological macrocycles with the solvent or the polymer with the solvent are pumped into the nozzle. The solvent in polyhemoglobin and poly(ethylene oxide) polymer is water. The solutions are pumped into the nozzle of an electrospun machine at a high voltage DC power supply. The electric field between two opposite electrodes in the nozzle is kept between 8000-80000V. The voltage between two electrodes for electrospinning depends on polymer concentration, polymer type and solvent compounds and solvent ions. The nozzle becomes conical in shape towards the exit. The formed nanofibers come out through the conical exit of the nozzle. The nanofibers become felt shape towards the opposite pole and collected. The movement of polymer with biological macrocycles and others molecules in the electric field causes an elimination of the toxic agents. The nanofibers coming out are woven with the conventional cigarette filter, according to one embodiment herein.

When the diameter of the polymer fiber materials are shrunk from micrometers to nanometers, there appears several amazing characteristics such as very large surface area to volume ratio (this ratio for a nano fiber can be as large as 1000 times of that of a microfiber), flexibility in surface functionalities, and superior mechanical performance compared with any other known form of the material. These outstanding properties make the polymer nanofibers to be optimal candidates for many important applications.

Capillary tube or nozzle used and hydrostatics pressure for electrospinning depends on solvent type, concentration, polymer type and specially volume of exited sample from electrospinning nozzle. According to an embodiment herein, the volume of exiting sample from the nozzle is 1 ml/hour to 5 ml/hour and the potential difference is 1000V-80000V. The distance between the nozzle and the collector is 7 cm to 30 cm for an industrial scale manufacture of the cigarette filter herein. The method is an electrostatic method carry out by roll and disc.

Biological macrocycles with the solvent and the polymer with the solvent (polyHb-POE polymer-water) and complex of this component by pumping when exiting from nozzle exposure with 1,000-80,000V electric field and then in the tip of nozzle forms conical fibers.

According to an embodiment herein, the polymer solution is introduced into the electric field. The polymer filaments are formed from the solution between two electrodes bearing electrical charges of opposite polarity. One of the electrodes is placed into the solution and the other onto a collector. Once ejected out of a metal needle with a small hole, the charged solution gets jet evaporated to become fibers, which were collected on the collector. The potential difference depends on the properties of the spinning solution, such as polymer molecular weight and viscosity. In the electro spinning process a high voltage is used to create an electrically charged jet of polymer solution or melt out of the needle. Before reaching the collecting screen, the solution jet evaporates or solidifies, and is collected as an interconnected web of small fibers. One electrode is placed into the spinning solution or melt and the other is attached to the collector. The conventional filter is placed between these electrodes and near the collector for enriching conventional filter.

Many parameters influence the transformation of polymer solutions into nanofibers through electro spinning. The solution properties such as viscosity, elasticity, conductivity, and surface tension. One of the most significant parameters influencing the fiber diameter is the solution viscosity. A higher viscosity results in a larger fiber diameter. For example poly (ethylene oxide) (PEO) dissolved in ethanol-to-water solutions that viscosities in the range of 1-20 poises and surface tension between 30 and 60 dynes/cm were suitable for fiber formation. At viscosities above 20 poises, electro spinning is prohibited because of the instability of flow caused by the high cohesiveness of the solution. Droplets are formed when the viscosity is too low (<1 poise). Deferent solvents and salt addition may contribute deferent surface tensions. Also the charges carried by the jet increases, higher elongation forces are imposed to the jet under the electrical field, resulting in thinner fiber diameters. Governing variables such as hydrostatic pressure in the capillary tube, electric potential at the capillary tip, and the gap or the distance between the tip and the collecting screen also influence the transformation of polymer solutions into nanofibers through electro spinning. Further, the ambient parameters such as solution temperature, humidity and air velocity in the electro-spinning chamber also influence the transformation of polymer solutions into nanofibers through electro spinning Temperature for remove the solvent or carrier from nanofiber depends on nanofiber use alone as a cigarette filter or combination with/or on the commercial filter and nanofiber added in when and where of cigarette filter machine Concentration of biological macrocycles after extraction and solving it in solvents and carriers useable in electrospinning are variable and depends on the type, volume and percentage of cigarette components. For electrospinning hemoglobin is 1 mg/ml-850 mg/ml.

Figure 3:
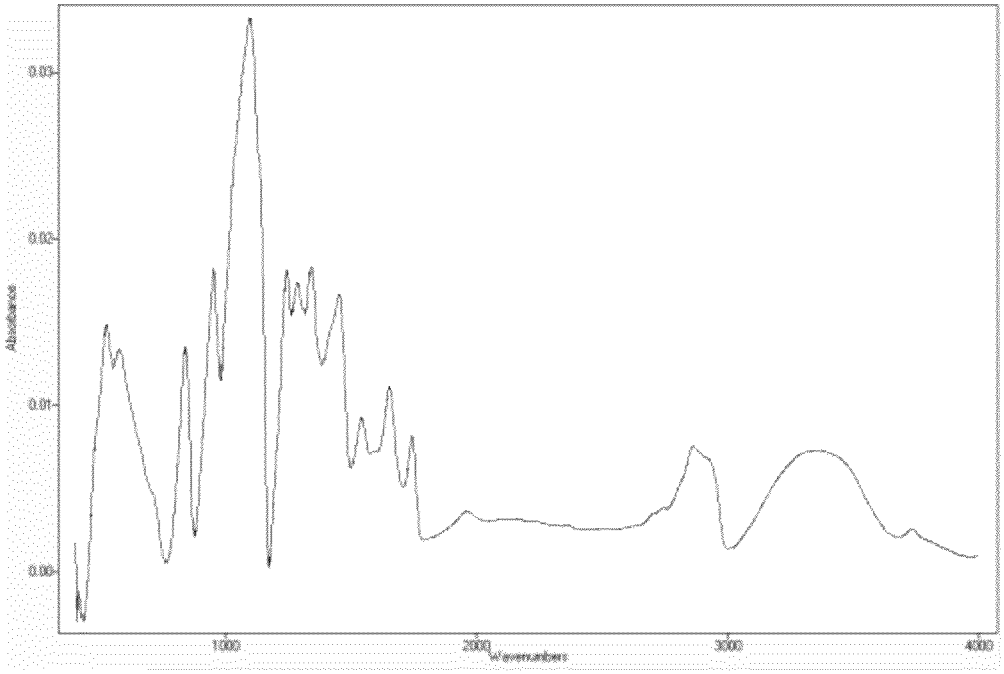
FIG. 3 shows an absorbance of the Fourier Transform Infrared (FTIR) spectra of the electrospun biological macrocycles with polymetal ions complexes according to one embodiment herein.

FIG. 3 shows the absorbance of the Fourier Transform Infrared (FTIR) spectra of the electrospun biological macrocycles with polymetal ions complexes according to one embodiment herein. With respect to FIG. 3, the highest peak of more than 0.03 absorbance is seen at around 1000 nm, which shows the presence of the electrospun biological macrocycles with polymetal ions complexes. The absorbance of FTIR spectra shows collection of spectra with various peaks from above complex no distinct peaks.

Figure 4:
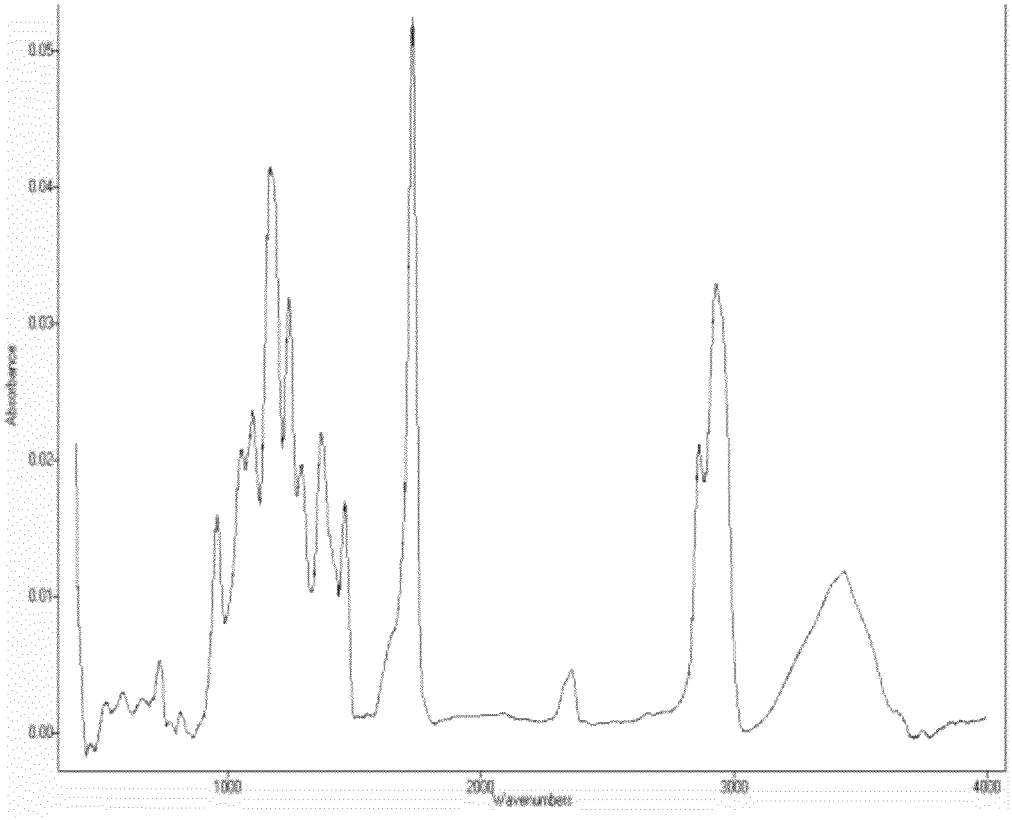
FIG. 4 shows an absorbance of the FTIR spectra of the engineered polynuclear complexes of biological macrocycles with polymetal ions complexes, according to an embodiment herein.

FIG. 4 shows the absorbance of the FTIR spectra of the engineered polynuclear complexes of biological macrocycles with polymetal ions complexes, according to an embodiment herein. With respect to FIG. 4, the peaks at 1000 nm, 1080 nm and 3000 nm shows the presence of the engineered polynuclear complexes of biological macrocycles with polymetal ions complexes.

Figure 5:
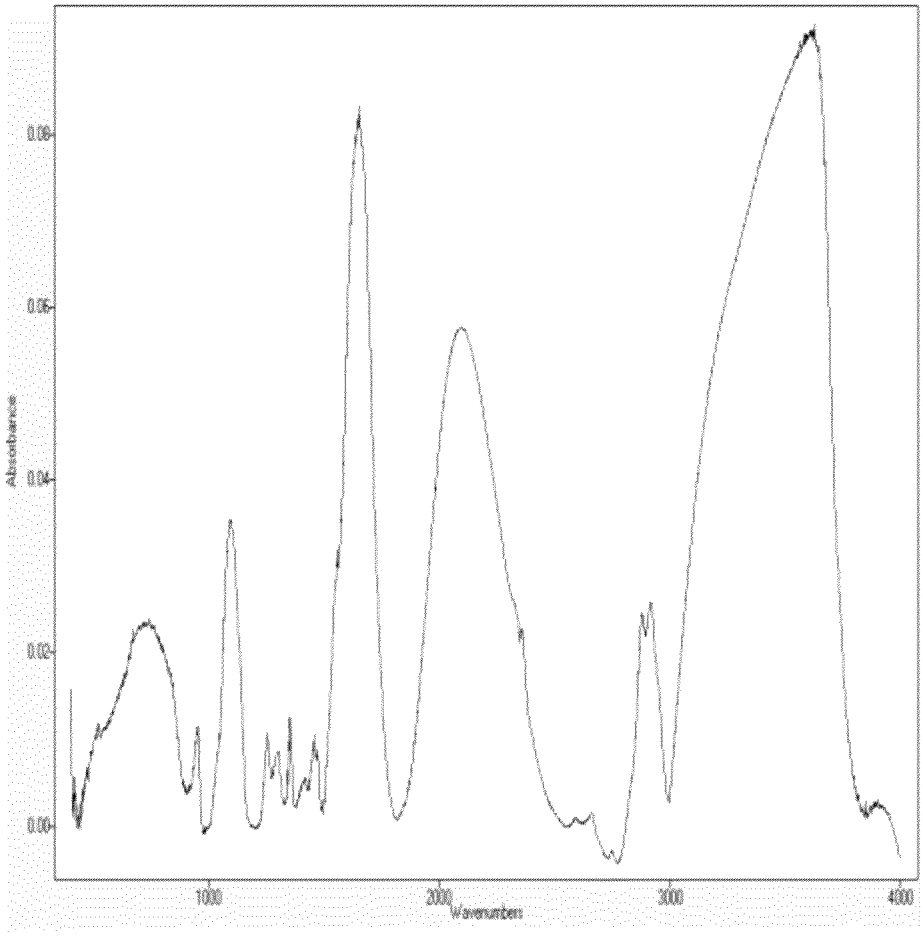
FIG. 5 shows an absorbance of the FTIR spectra of the biological macrocycles with polymetal ions complexes, according to an embodiment herein.

FIG. 5 shows the absorbance of the FTIR spectra of the biological macrocycles with polymetal ions complexes, according to an embodiment herein. With respect to FIG. 5, the various peaks show the presence of the biological macrocycles with polymetal ions complexes.

Figure 6:
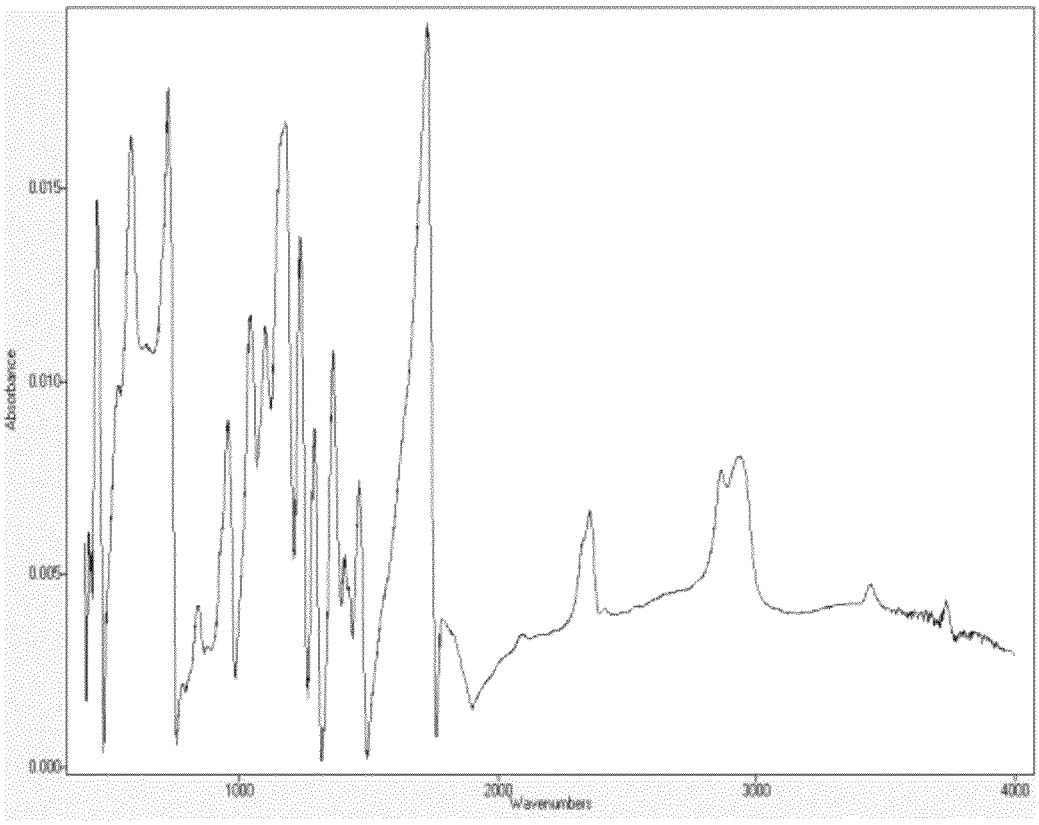
FIG. 6 shows an absorbance of the FTIR spectra of the electrospun and engineered polynuclear complexes of biological macrocycles with polymetal ions complexes, according to an embodiment herein.

FIG. 6 shows the absorbance of the FTIR spectra of the electrospun and engineered polynuclear complexes of biological macrocycles with polymetal ions complexes, according to an embodiment herein. With respect to FIG. 6, the peaks show the presence of the electrospun and engineered polynuclear complexes of biological macrocycles with polymetal ions complexes.

Figure 7:
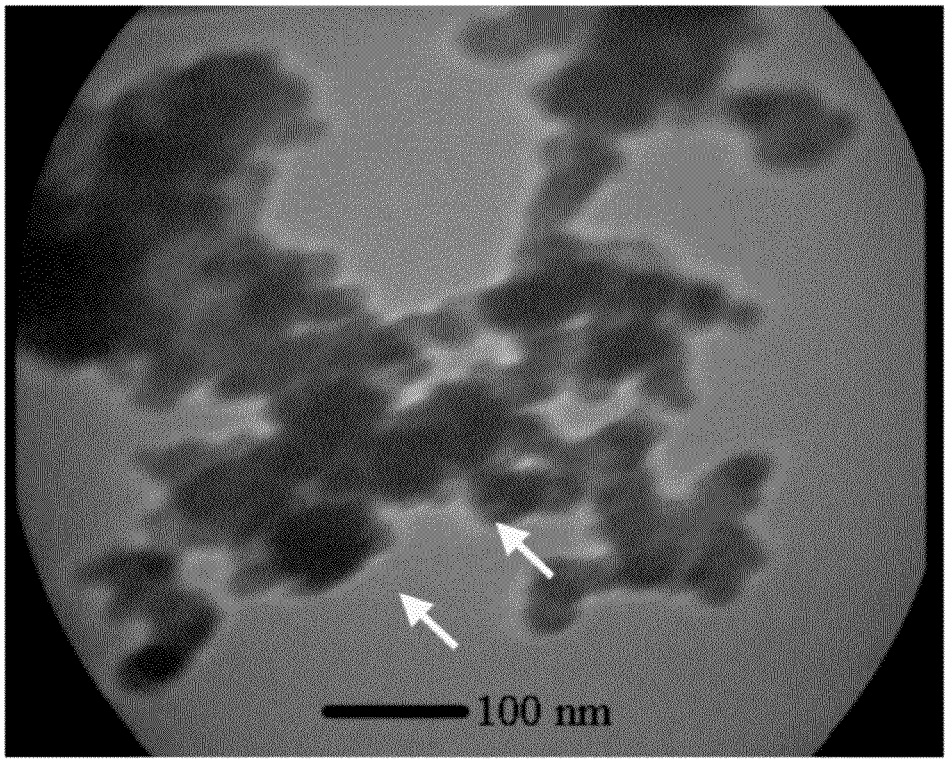
FIG. 7 shows a Transmission Electron Microscopic (TEM) image of the biofilter comprising the biological macrocycles with polymetal ions complexes produced by a reaction performed, according to an embodiment herein.

FIG. 7 shows the Transmission Electron Microscopic (TEM) image of the biofilter comprising the biological macrocycles with polymetal ions complexes produced by a reaction performed, according to an embodiment herein. With respect to FIG. 7, the scale is 100 nm and the arrows show the presence of the biological macrocycles with polymetal ions complexes produced herein.

Figure 8:
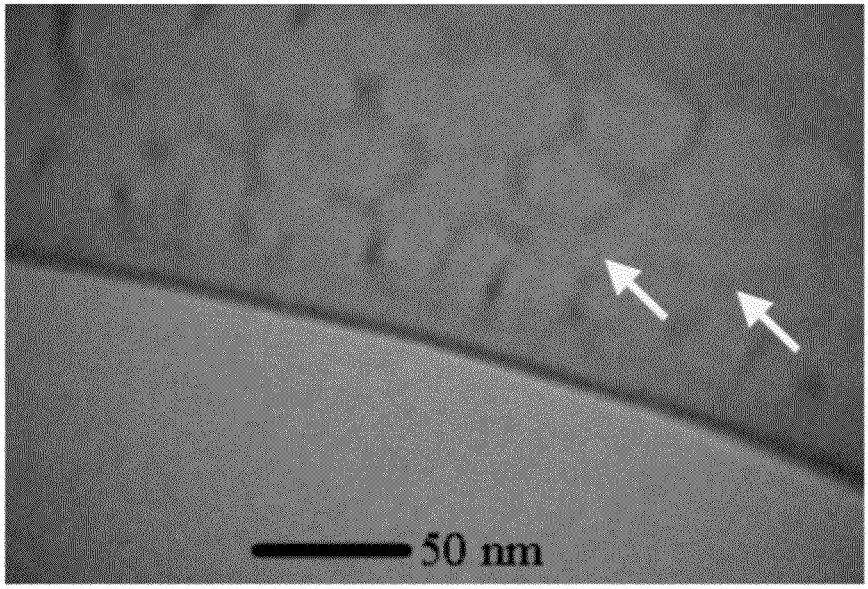
FIG. 8 shows a TEM image of the biofilter comprising the biological macrocycles with polymetal ions complexes produced by a reaction performed, according to an embodiment herein.

FIG. 8 shows the TEM image of the biofilter comprising the biological macrocycles with polymetal ions complexes produced by a reaction performed, according to an embodiment herein. With respect to FIG. 8, the scale is 50 nm and the arrows show the presence of the biological macrocycles with polymetal ions complexes produced herein.

Figure 9:
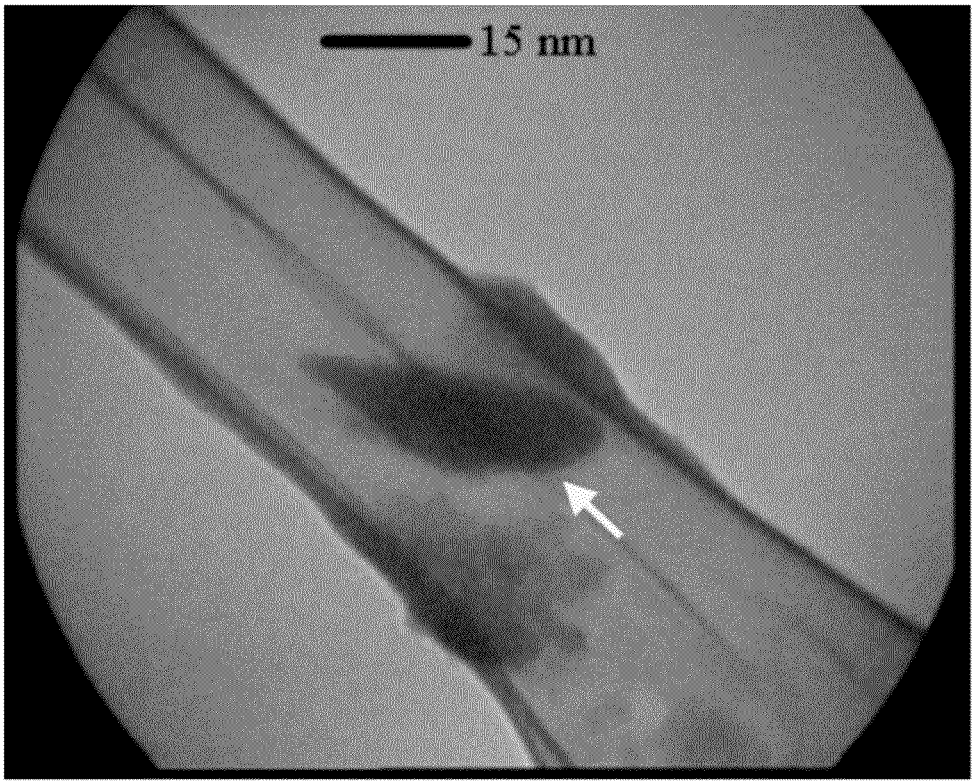
FIG. 9 shows a TEM image of the biofilter comprising the biological macrocycles with polymetal ions complexes produced by a reaction performed, according to an embodiment herein.

FIG. 9 shows the TEM image of the biofilter comprising the biological macrocycles with polymetal ions complexes produced by a reaction performed, according to an embodiment herein. With respect to FIG. 9, the scale is 15 nm and the arrows show the presence of the biological macrocycles with polymetal ions complexes produced herein.

Figure 10:
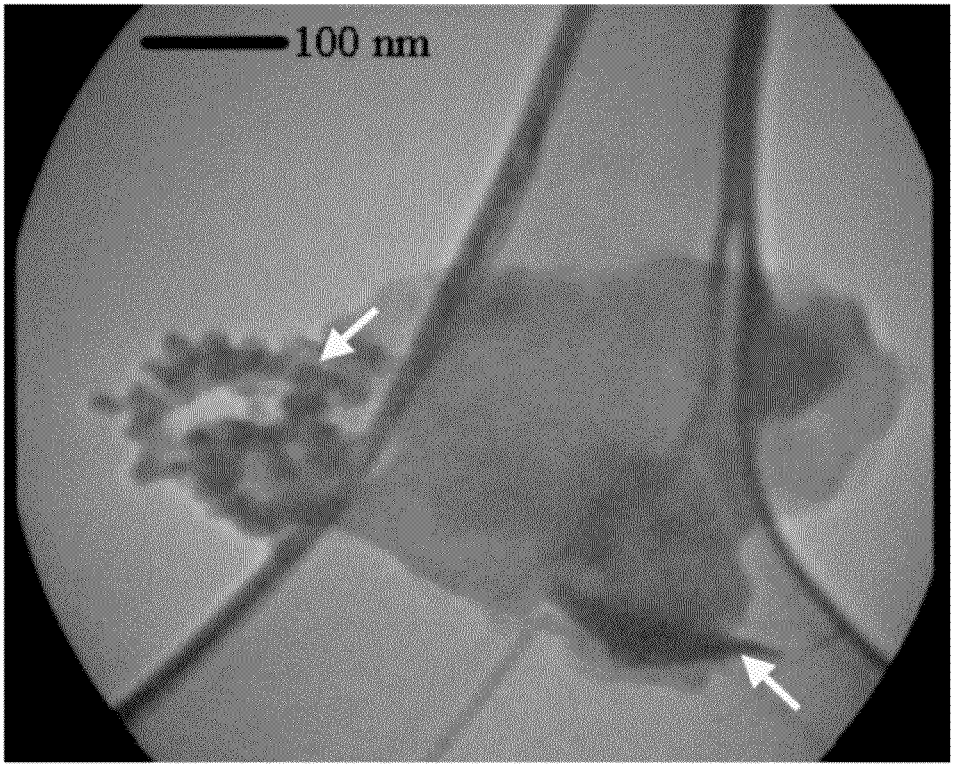
FIG. 10 shows a TEM image of the biofilter comprising the biological macrocycles with polymetal ions complexes produced by a reaction performed, according to an embodiment herein.

FIG. 10 shows the TEM image of the biofilter comprising the biological macrocycles with polymetal ions complexes produced by a reaction performed, according to an embodiment herein. With respect to FIG. 10, the scale is 100 nm and the arrows show the presence of the biological macrocycles with polymetal ions complexes produced herein.

Figure 11:
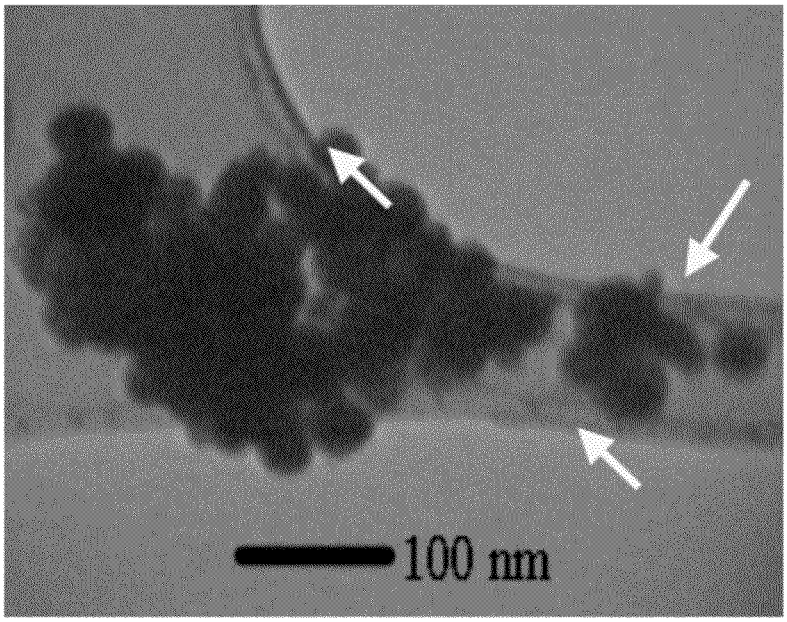
FIG. 11 shows a TEM image of the biofilter comprising the electrospun nanofibers with nano-dimension diameter network of engineered polymetal ions complexes produced by a reaction performed, according to an embodiment herein.

FIG. 11 shows the TEM image of the biofilter comprising the electrospun nanofibers with nano-dimension diameter network of engineered polymetal ions complexes produced by a reaction performed, according to an embodiment herein. With respect to FIG. 11, the arrows show the presence of the biofilter comprising the electrospun nanofibers with nano-dimension diameter network of engineered polymetal ions complexes produced herein.

Figure 12:
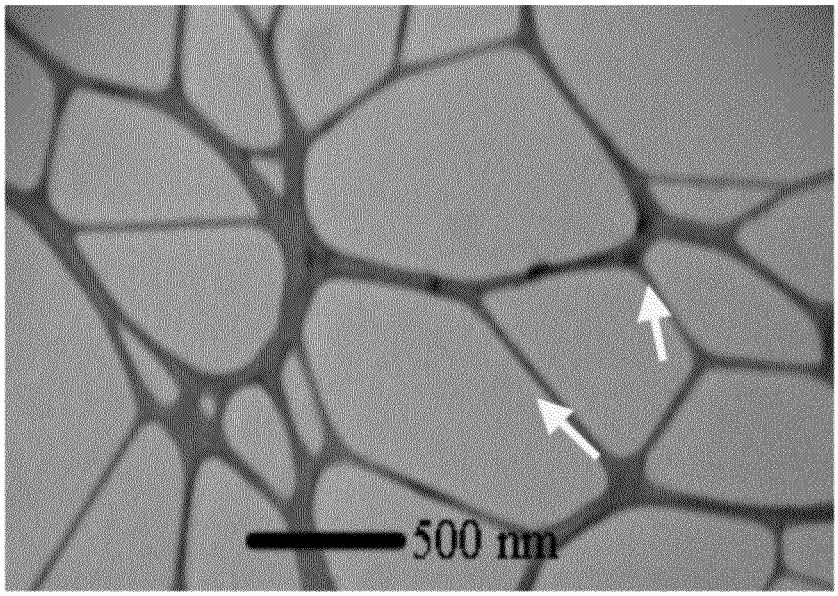
FIG. 12 shows a TEM image of the biofilter comprising nanofibers with nano-dimension diameter networks of polymetal ions complexes produced by a reaction performed, according to an embodiment herein.

FIG. 12 shows the TEM image of the biofilter comprising nanofibers with nano-dimension diameter networks of polymetal ions complexes produced by a reaction performed, according to an embodiment herein. With respect to FIG. 12, the nano-dimension networks can be seen.

Figure 13:
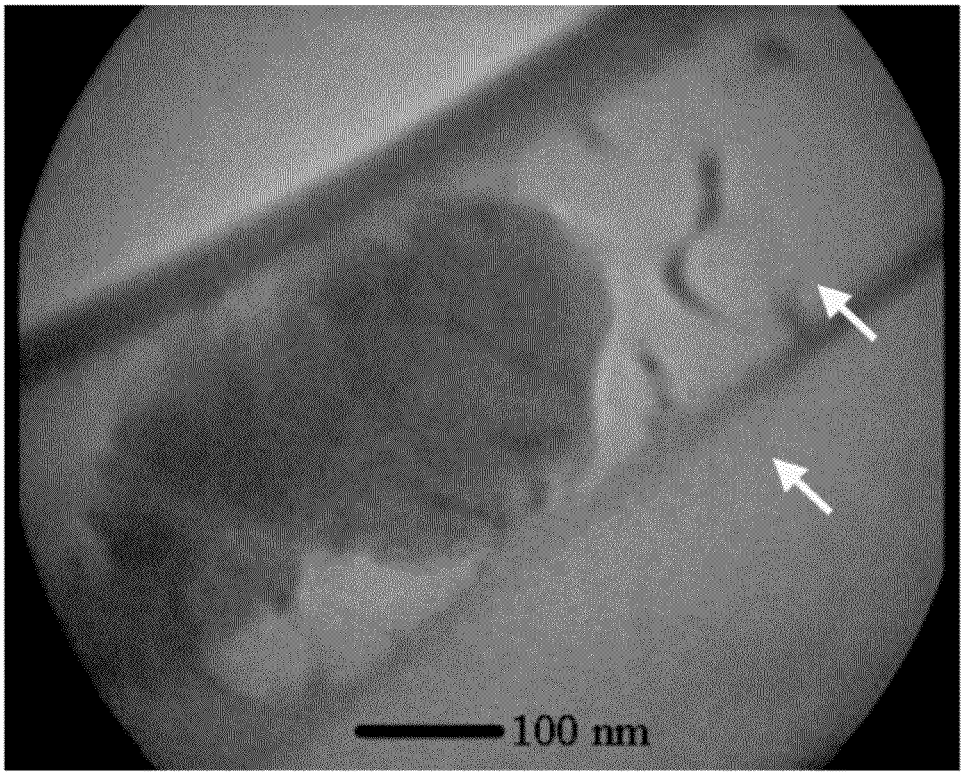
FIG. 13 shows a TEM image of the biofilter comprising the nanofibers with nano-dimension diameter networks of polymetal ions complexes produced by a reaction performed, according to an embodiment herein.

FIG. 13 shows the TEM image of the biofilter comprising the nanofibers with nano-dimension diameter networks of polymetal ions complexes produced by a reaction performed, according to an embodiment herein. With respect to FIG. 13, the nanofibers with nano-dimension diameter networks can be seen.

Figure 14:
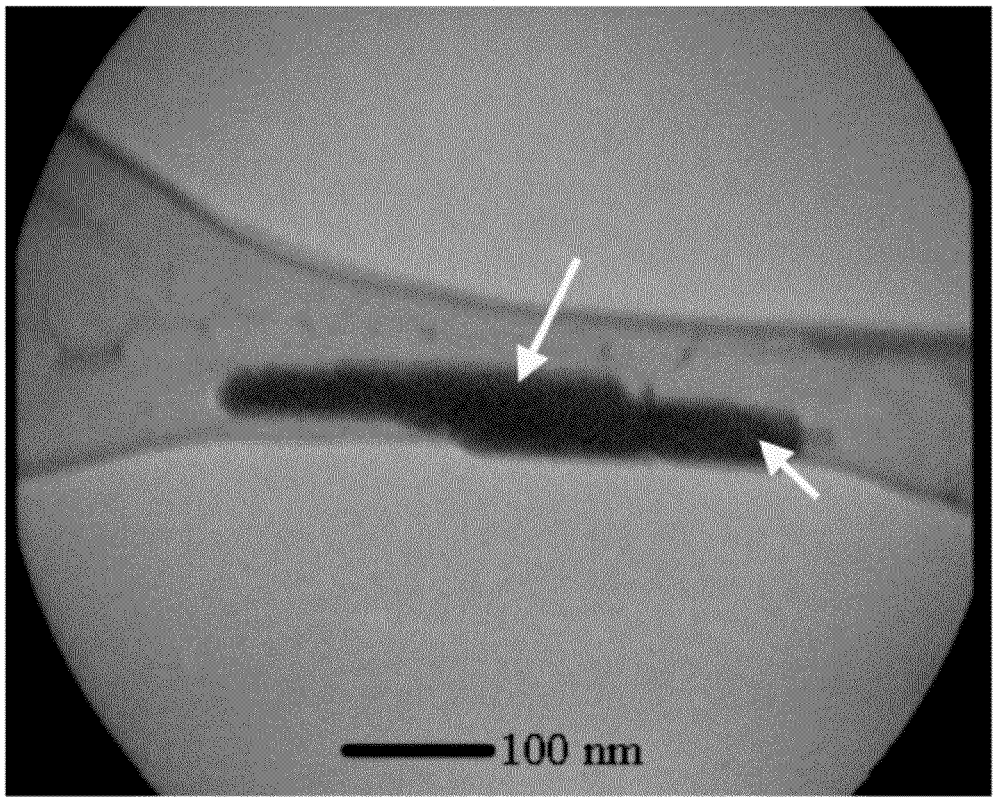
FIG. 14 shows a TEM image of the biofilter comprising nanofibers with nano-dimension diameter networks of polymetal ions complexes produced by a reaction performed, according to an embodiment.

FIG. 14 shows the TEM image of the biofilter comprising nanofibers with nano-dimension diameter networks of polymetal ions complexes produced by a reaction performed, according to an embodiment. With respect to FIG. 14, the nanofibers with nano-dimension diameter networks can be seen.

Figure 15:
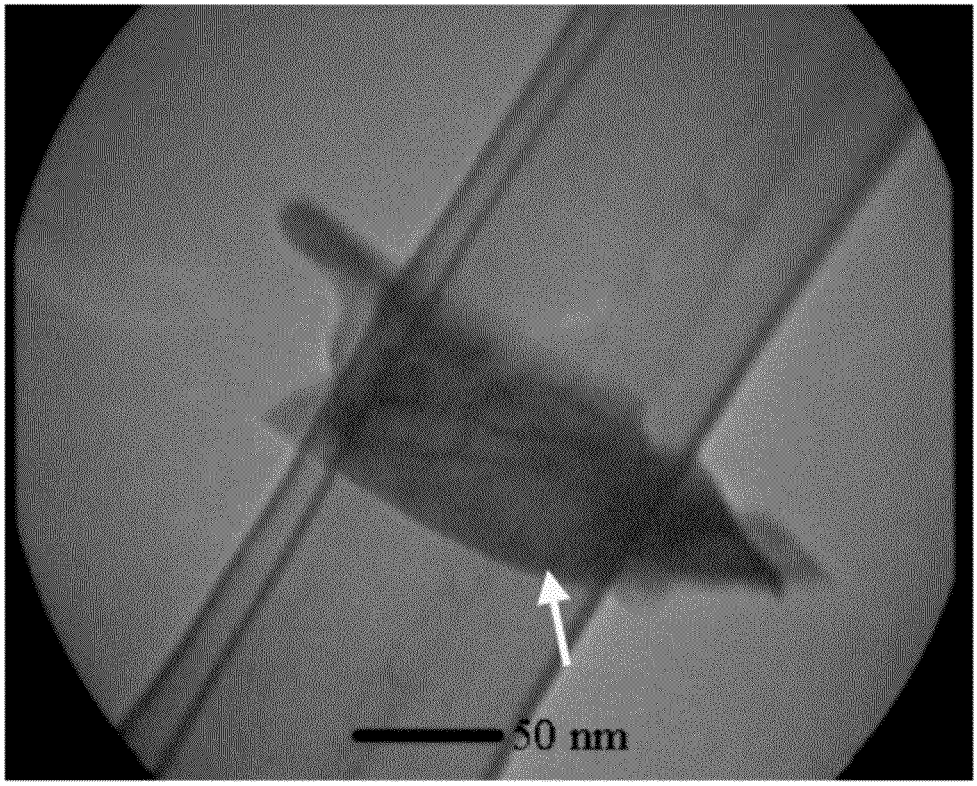
FIG. 15 shows a TEM image of the biofilter comprising the nanofibers with nano-dimension diameter networks of polymetal ions complexes produced by a reaction performed, according to an embodiment herein.

FIG. 15 shows the TEM image of the biofilter comprising the nanofibers with nano-dimension diameter networks of polymetal ions complexes produced by a reaction performed, according to an embodiment herein. With respect to FIG. 15, the nanofibers with nano-dimension diameter networks can be seen.

Figure 16:
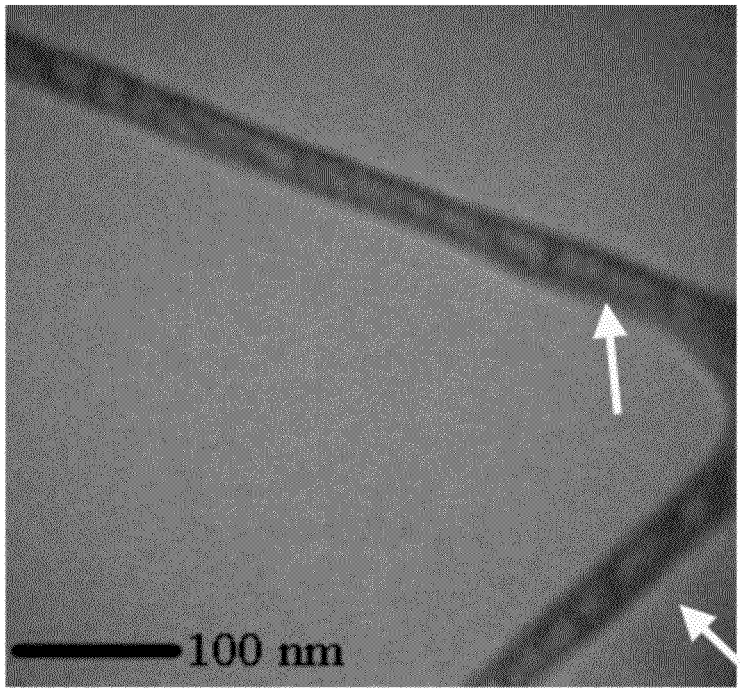
FIG. 16 shows a TEM image of the biofilter comprising electrospun nanofibers with nano-dimension diameter networks of engineered polymetal ions complexes produced by a reaction performed according to one embodiment.

FIG. 16 shows the TEM image of the biofilter comprising electrospun nanofibers with nano-dimension diameter networks of engineered polymetal ions complexes produced by a reaction performed according to one embodiment. With respect to FIG. 16, the electrospun nanofibers with nano-dimension diameter networks can be seen.

Figure 17:
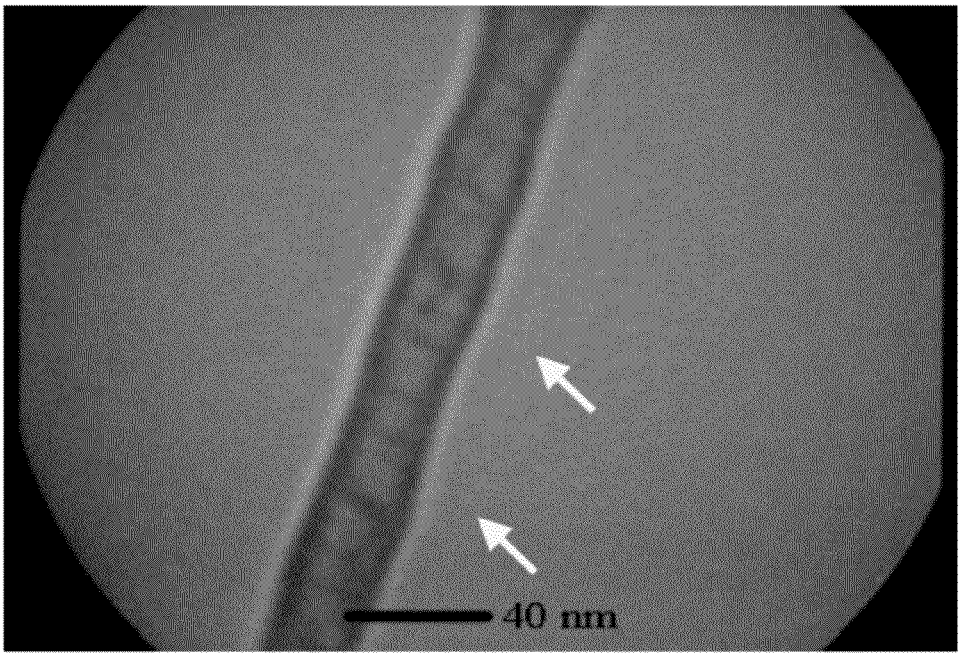
FIG. 17 shows a TEM image of the biofilter comprising the electrospun nanofibers with nano-dimension diameter networks of engineered polymetal ions complexes produced by a reaction performed according to one embodiment.

FIG. 17 shows the TEM image of the biofilter comprising the electrospun nanofibers with nano-dimension diameter networks of engineered polymetal ions complexes produced by a reaction performed according to one embodiment. With respect to FIG. 17, the electrospun nanofibers with nano-dimension diameter networks in a scale of 40 nm of the TEM can be seen.

Figure 18:
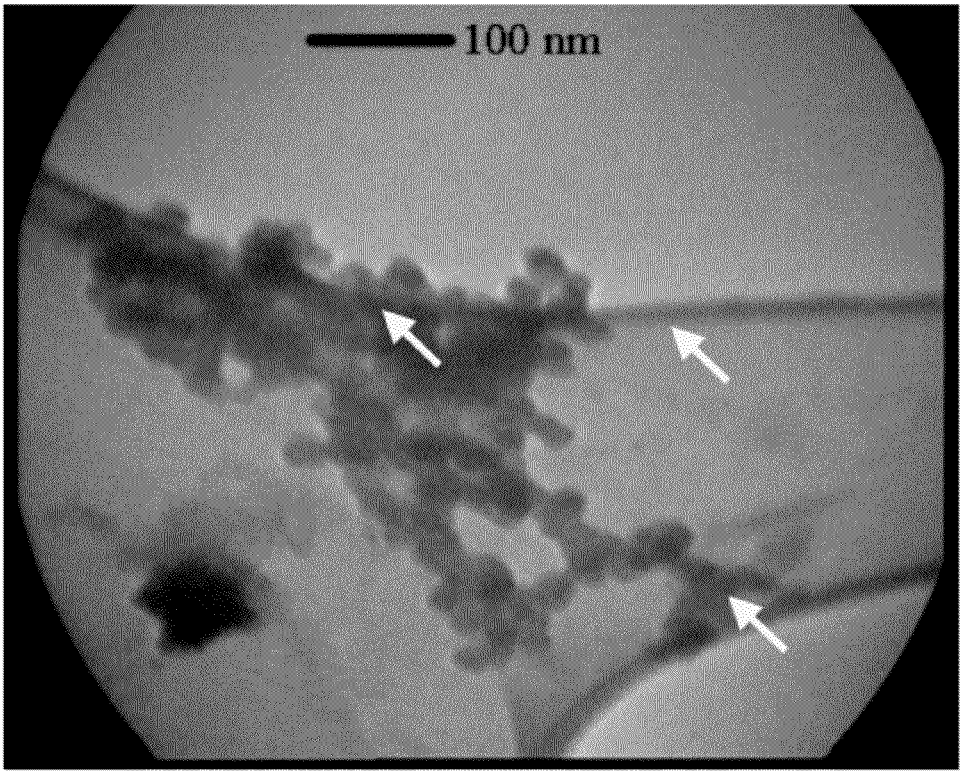
FIG. 18 shows a TEM image of the biofilter comprising the electrospun nanofibers with nano-dimension diameter networks of engineered polymetal ions complexes produced by a reaction performed, according to an embodiment herein.

FIG. 18 shows the TEM image of the biofilter comprising the electrospun nanofibers with nano-dimension diameter networks of engineered polymetal ions complexes produced by a reaction performed, according to an embodiment herein. With respect to FIG. 18, the electrospun nanofibers with nano-dimension diameter networks can be seen.

Figure 19:
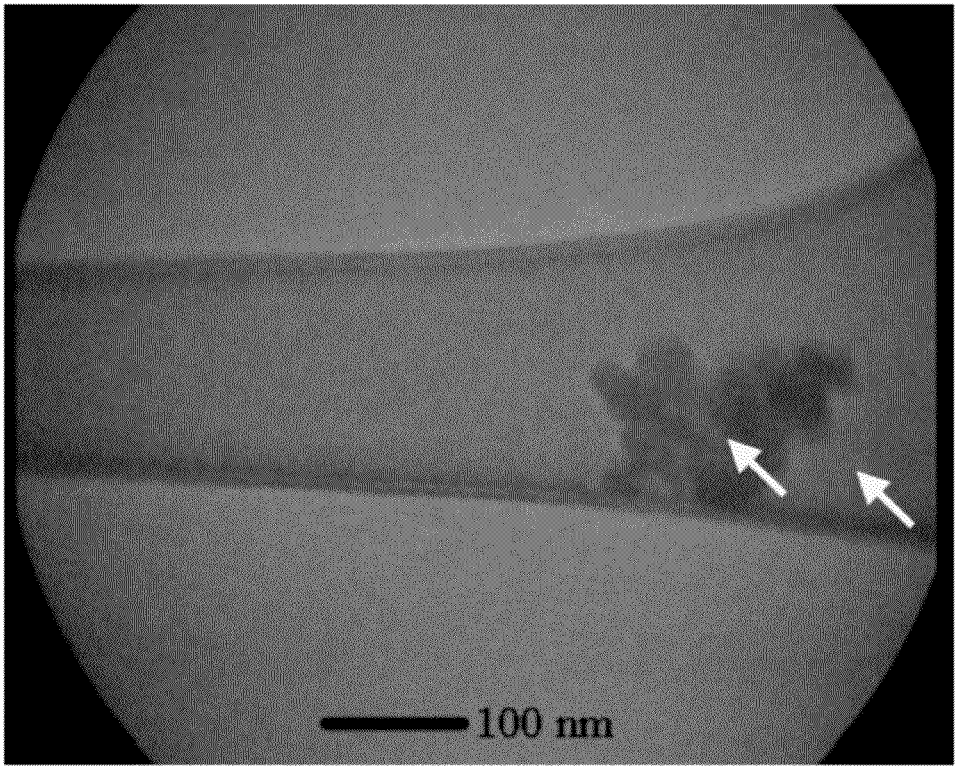
FIG. 19 shows a TEM image of the biofilter comprising the electrospun nanofibers with nano-dimension diameter network of engineered polymetal ions complexes produced by a reaction performed, according to an embodiment herein.

FIG. 19 shows the TEM image of the biofilter comprising the electrospun nanofibers with nano-dimension diameter network of engineered polymetal ions complexes produced by a reaction performed, according to an embodiment herein. With respect to FIG. 19, the electrospun nanofibers with nano-dimension diameter networks can be seen.

The embodiments herein are supported with following examples. The examples set forth are not meant to limit the scope in any manner.

EXAMPLE 1

Formation of engineered polyhemoglobin: The red blood cells in fresh sheep blood are separated from plasma by centrifugation. The units of red blood cells are washed three times with 0.9% NaCl and centrifuged for 10 minutes at 4000 g. The washed and packed RBCs were lysed with 3 to 4 volumes of pyrogen free water to rupture the intact cell wall and separate the hemoglobin. The lysis was completed by vigorously shaking. The lysed erythrocyte-water mixture was freed of stroma by extraction with ice-cold toluene or dialysis methods. The polymerization according to the embodiments herein is not intended to limit the scope of the invention to the ligand form of hemoglobin, as cross-linking occurs independent of the ligand state. Hemoglobin in phosphate buffer in 4° C. react with glutaraldehyde in presence of low dose of lysine monohydrochloride in phosphate buffer, the solution is equilibrated with nitrogen for 18 hours to remove any air contamination. The cross-linking reaction was quenched by added high dose lysine solution. After quenching, the solution was oxygenated and then dialyzed to remove unbound glutaraldehyde and excess lysine.

EXAMPLE 2

Preparation of Chlorophyll solution: Chlorophyll A is the most widespread of all of the chlorophylls, being ubiquitous to all plants, algae and cyanobacteria. The hot ethanol extraction method for chlorophyll A in tobacco was used. A method exists where chlorophyll is extracted in acetone. However, the acetone extraction has been shown to underestimate the amount of chlorophyll present and in a direct comparison between the hot ethanol extraction and acetone extraction, the extraction efficiency was shown to be much greater in ethanol than in acetone. Homogenized sample of green tobacco (100.00 g) in 95% Cold ethanol (50 ml) putted into the flask and covered with perforated aluminum foil. The flask was placed over a steam bath and swirled occasionally until the ethanol boiled. The contents of the flask were then filtered through Whatman no. 1 filter paper. The flask was rinsed with an additional 25 ml of hot ethanol, which was then added to the filter.

1.2 g poly(ethylene oxide) (PEO) with a molecular weight (MW) of 6,00,000, dissolved in 6 ml of this solution and 4 ml distilled water and electro spinning in 18-20 kv electric potential gradient. The fibers were collected on a stainless steel collector located a distance of approximately 15 cm from the nozzle.

EXAMPLE 3

Preparation of a stroma-free hemoglobin solution: 100 cc of fresh sheep blood is released from plasma and buffy-coat by centrifugation. The units of red blood cells are washed three times in plastic bags with 0.51 1% NaCl and centrifuged for seven minutes at 4500 g. 20 cc of washed RBCs were poured into 60-80 cc of cold pyrogen free water. The yield of the stroma-free hemoglobin solution is 30-40%. The stroma-free hemoglobin is pasteurized for ten hours at 61° C. 1.2-1.5 g poly(ethylene oxide) (PEO) with a molecular weight (MW) of 600,000, dissolved in 10 ml of this solution and electro spinning in 20-22 kv electric potential gradient. The fibers were collected on a stainless steel collector located a distance of approximately 18-20 cm from the nozzle.

EXAMPLE 4

The fibers from the nozzle in example 1 and/or 2 collected on a conventional filter.

It is widely known that tobacco smoke contains mutagenic and carcinogenic compounds, which cause substantial morbidity and mortality to smokers. Examples of such substances include polycyclic aromatic hydrocarbons (PAH) and nitrosamines. Polycyclic aromatic hydrocarbons appear to cause toxicity by intercalating within DNA molecules. Nitrosamines are electrophilic, alkylating agents, which are potent carcinogens. Nitrosamines are not present in fresh or green tobaccos and are not formed during combustion. Nitrosamines are instead formed by reactions involving free nitrate during processing and storage of tobacco, or by the post-inhalation, metabolic activation of secondary amines present in tobacco smoke. So, the natural or synthetic poly macrocycles according to the embodiments herein can removes the toxic compounds.

The increase of surface to volume ratio in nanostructures according to the embodiments herein and their high contact surfaces leads to the removal of the toxic and mutagenic compounds from the cigarette smoke by their absorption on the biological materials of the nanofibers without providing resistance to the passing smoke. The biological substances according to the embodiment herein are attached directly as particles to the surface of the nanofibers or the biological substances are electrospun with nanofibers. According to the embodiments herein, engineered biological or synthetics macrocycles or poly macrocycles are used herein. The engineered biological macrocycles are placed on or inside the nanofibers and commercial filter as an embodiment herein either separately or in combination via electrospinning method. The non-toxicity of non-polymerized hemoglobin has been proven for living cells. The use of nontoxic biological macrocycles and polymacrocycles such as polyhemoglobin increase the absorbency of gaseous compounds by the nanostructures or nanofiber electrospinning.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments.

It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments, which as a matter of language might be said to fall there between.

What is claimed is:

1. An electrospun fiber mat filter for a cigarette filter containing macrocycle for removing toxic compounds from a toxic material, wherein the toxic material comprises liquid, gas, and cigarette smoke, comprising:

a biological macromolecule comprising macrocycle, wherein the biological macromolecule includes polynuclear complexes with polymetal ions and a combination thereof, and wherein the polynuclear complexes are polyporphyrin rings, and wherein the polymetal ions include ferrous ions (Fe2), cuprous ions (Cu2+), manganese ions (Mg2+) and zinc ions (Zn2), and wherein the biological macromolecule is an engineered polyhemoglobin;

and optionally a synthetic or an organic macrocycle selected from a group consisting of crown ethers, cryptands, spherands, carcerands, cyclodextrins, cyclophanes, and calixarenes.

2. The cigarette filter according to claim 1, wherein the engineered polyhemoglobin includes at least one stromal-free hemoglobin tetramer ($Hb_4$), wherein the at least one stromal-free hemoglobin tetramer ($Hb_4$) is cross-linked within, and wherein or the at least one stromal-free hemoglobin tetramer ($Hb_4$) is cross linked with at least one another heme containing hemoglobin monomer (Hb) to yield a macro-molecular compound, wherein the macro-molecular compound has a general formula of poly$(Hb)_n$, wherein the Hb is a hemoglobin monomer and wherein n is 4 to 60.

3. The cigarette filter according to claim 1, wherein the biological macromolecule includes heterocyclic macrocycles, and wherein the heterocyclic macrocycles include corrins, corrinoids, chlorins, porphyrin and bacteriochlorin.

4. The cigarette filter according to claim 1, wherein the acceptable polymeric carrier includes homopolymers and copolymers of the homopolymers, organic or inorganic hybrid polymers, wherein the homopolymers include polyurethanes, polyacrylonitrile, polyvinyl alcohol (PVA), polylactic acid, polyethylene-co-vinyl acetate, polycarbonate, poly(iminocarbonates), polymethacrylates, poly(alkyl methacrylic acids), polyacrylates, poly(alkyl acrylic acids), poly (N,N'-diethylaminoethyl methacrylate), poly(N,N'-dialkylaminoalkyl acrylamides), poly(ethylene oxide) (PEO), polyethylene terephthalate, polystyrene, polyvinyl chloride (PVC), poly vinyl phenol, polyacrylamide, poly(N-alkyl acrylamides), poly lactic-co-glycolic acids, polycaprolactone, poly(2-hydroxyethyl methacrylate), poly(vinylidene fluoride), poly(vinylidene chloride), poly(ethylene glycol) (PEG), polyvinyl pyrrolidone, polyethylene, polypropylene, poly(3-hydroxybutyrate), poly(ortho esters), polyanhydrides, poly(ether-ester) azopolymers, poly(dimethyl siloxane), and poly(phosphazenes), and wherein the organic or inorganic hybrid polymers include ethylene oxide-polypropylene glycol condensates, polystyrene, polyamide, polyacrylonitrile, polyimide, poly vinylidene chloride (PVDC), poly tetra-fluoro ethylene (PTFE), polyester, polysulfone, polyolefin, polysilsesquioxane, silicone, epoxy, polyketone, polyether, polyamine, polyphosphazene, polysulfide, polybutadiene, polyethylene, cellulose, polylactones, proteins, poly(vinyl pyrrolidone), and poly(styrene sulfonate), or combinations thereof, and wherein the polymers include preferably water-soluble polymers or hydrolyzable polymers, wherein the water-soluble polymers or hydrolyzable polymers are selected from a group consisting of poly(ethylene oxide) (PEO), polylactide (PLA), polyglycolide (PGA), polycaprolactone (PCL), polyhydroxybutyrate (PHB), polyhydroxyvalerate (PHBV), polyvinyl alcohol (PVA) cellulose, cellulose acetate, chitosan, collagen, DNA, fibrinogen, and fibronectin, and wherein the acceptable polymeric carrier is poly(ethylene oxide) (PEO).

5. The cigarette filter according to claim 1, wherein the solvent includes water, 1,1,1,3,3,3-hexafluoropropanol, tetrafluoromethane, chloroform, methanol, N,N-dimethylacetamide, N,N-dimethylformamide, tetrahydrofuran, formamide, toluene, 1-propanol, 2-propanol, ethanol, dichloromethane, formamide, dimethylacetamide, methylene chloride, chlorobenzene, chloroform, carbon tetrachloride, chlorobenzene, chloroacetonitrile, carbon disulfide, dimethylsulfoxide, benzene, styrene, acetonitrile, tetrahydrofuran, acetone, methylethylketone, dioxanone, cyclohexanone, cyclohexane, dioxane, 1-nitropropane, tributylphosphate, ethyl acetate, phosphorus trichloride, butanol, glycol, phenol, diethylene glycol, polyethylene glycol, and 1,4-butanediol and wherein the solvent is a solution of ethanol in water.

6. The cigarette filter according to claim 1, wherein the plurality of additives include chitosan, active charcoal, antioxidants, vitamins, nucleic acids, drugs, peptides, proteins, vegetable oil, humectants, polysaccharides, dextran, gum arabic, pectin, fluid gelatin and hydroxyethyl starch.

7. The cigarette filter according to claim 1, wherein the fiber diameter is between 50 nm to 10000 nm.

8. A method of synthesizing an electrospun fiber mat cigarette filter for removing toxic compounds from a cigarette smoke comprising:

obtaining an biological macromolecule, wherein the biological macromolecule is an engineered hemoglobin;

polymerizing the prepared biological macromolecule to form a polymerized engineered biological macromolecule, wherein the polymerized engineered biological macromolecule is a polymerized engineered polyhemoglobin;

mixing the polymerized biological macromolecule with an additive, a solvent and an acceptable polymeric carrier to form a mixture; and electrospinning the formed mixture in a presence of an abruptly asymmetric electric field to form an electrospun fiber mat, and wherein the electrospun fiber mat is made up of networks of a plurality of nanofibers.

9. The method according to claim 8, wherein the step of obtaining the engineered polyhemoglobin comprises: Extraction of pure hemoglobin from separated red blood cells (RBCs), polymerized hemoglobin with glutaraldehyde or any acceptable polymerization methods.

10. The method according to claim 8, wherein the solvent has a viscosity in a range of 1-20 poise, and wherein the solvent has a surface tension in a range of 30 and 60 dynes/cm.

11. The method according to claim 8, wherein the biological macromolecule include heterocyclic macrocycles, and wherein the heterocyclic macrocycles include corrins, corrinoids, chlorins, porphyrin and bacteriochlorin.

12. The method according to claim 8, wherein the acceptable polymeric carrier includes homopolymers and copolymers of the homopolymers, organic or inorganic hybrid polymers, wherein the homopolymers include polyurethanes, polyacrylonitrile, polyvinyl alcohol (PVA), polylactic acid, polyethylene-co-vinyl acetate, polycarbonate, poly(iminocarbonates), polymethacrylates, poly(alkyl methacrylic acids), polyacrylates, poly(alkyl acrylic acids), poly(N,N'-diethylaminoethyl methacrylate), poly(N,N'-dialkylaminoalkyl acrylamides), poly(ethylene oxide) (PEO), polyethylene terephthalate, polystyrene, polyvinyl chloride (PVC), poly vinyl phenol, polyacrylamide, poly(N-alkyl acrylamides), poly lactic-co-glycolic acids, polycaprolactone, poly (2-hydroxyethyl methacrylate), poly(vinylidene fluoride), poly(vinylidene chloride), poly(ethylene glycol) (PEG), polyvinyl pyrrolidone, polyethylene, polypropylene, poly(3-hydroxybutyrate), poly(ortho esters), polyanhydrides, poly (ether-ester) azopolymers, poly(dimethyl siloxane), and poly (phosphazenes), and wherein the organic or inorganic hybrid polymers include ethylene oxide-polypropylene glycol condensates, polystyrene, polyamide, polyacrylonitrile, polyimide, poly vinylidene chloride (PVDC), poly tetra-fluoro ethylene (PTFE), polyester, polysulfone, polyolefin, polysilsesquioxane, silicone, epoxy, polyketone, polyether, polyamine, polyphosphazene, polysulfide, polybutadiene, polyethylene, cellulose, polylactones, proteins, poly(vinyl pyrrolidone), and poly(styrene sulfonate), or combinations thereof, and wherein the polymers include preferably water-soluble polymers or hydrolyzable polymers, wherein the water-soluble polymers or hydrolyzable polymers are selected from a group consisting of poly(ethylene oxide) (PEO), polylactide (PLA), polyglycolide (PGA), polycaprolactone (PCL), polyhydroxybutyrate (PHB), polyhydroxyvalerate (PHBV), polyvinyl alcohol (PVA) cellulose, cellulose acetate, chitosan, collagen, DNA, fibrinogen, and fibronectin.

13. The method according to claim 8, wherein the solvent includes water, 1,1,1,3,3,3-hexafluoropropanol, tetrafluoromethane, chloroform, methanol, N,N-dimethylacetamide, N,N-dimethylformamide, tetrahydrofuran, formamide, toluene, 1-propanol, 2-propanol, ethanol, dichloromethane, formamide, dimethylacetamide, methylene chloride, chlorobenzene, chloroform, carbon tetrachloride, chlorobenzene, chloroacetonitrile, carbon disulfide, dimethylsulfoxide, benzene, styrene, acetonitrile, tetrahydrofuran, acetone, methylethylketone, dioxanone, cyclohexanone, cyclohexane, dioxane, 1-nitropropane, tributylphosphate, ethyl acetate, phosphorus trichloride, butanol, glycol, phenol, diethylene glycol, polyethylene glycol, and 1,4-butanediol.

14. The method according to claim 8, wherein the additive includes chitosan, active charcoal, anti-oxidants, vitamins, nucleic acids, drugs, peptides, proteins, vegetable oil, humectants, polysaccharides, dextran, gum arabic, pectin, fluid gelatin and hydroxyethyl starch.

15. The method according to claim 8, wherein the nanofibers diameter is between 50 nm to 10000 nm.

16. The filter according to claim 1, wherein said toxic material comprises of carbon monoxide, sulfur dioxide, nitrogen oxide (NO.sub.x), ammonia, formaldehyde, carbon dioxide, aldehydes, free radicals, carcinogenic nitroso compounds, H.sub.2 O.sub.2, trace elements present and heavy metal.

17. The method according to claim 8, wherein the step of electrospinning further comprises a use of two electrodes, wherein the two electrodes bear an opposite charges, and wherein a one electrode connect to a nozzle that contain: the biological macromolecule consisting of an engineered polyhemoglobin and/or chlorophyll; a plurality of additives; a solvent; and an acceptable polymeric carrier and wherein a second electrode is placed onto a collector of an electro spinning machine.

* * * * *